US006199092B1

(12) United States Patent
Shibata et al.

(10) Patent No.: US 6,199,092 B1
(45) Date of Patent: Mar. 6, 2001

(54) SEMICONDUCTOR ARITHMETIC CIRCUIT

(75) Inventors: Tadashi Shibata, 3-16-411, Echujima 4-chome, Koto-ku, Tokyo 135-0044; Akira Nakada; Masahiro Konnda, both of Miyagi-ken; Tadahiro Ohmi, 1-17-301, Komegabukuro 2-chome, Aoba-ku, Sendai-shi, Miyagi-ken 980-0813; Takahisa Nitta, Tokyo, all of (JP)

(73) Assignees: Tadahiro Ohmi, Miyagi-ken; Tadashi Shibata; Kabushiki Kaisha UltraClean Technology Research Institute, both of Tokyo, all of (JP)

( * ) Notice: Subject to any disclaimer, the term of this patent is extended or adjusted under 35 U.S.C. 154(b) by 0 days.

(21) Appl. No.: 09/158,244

(22) Filed: Sep. 22, 1998

(30) Foreign Application Priority Data

Sep. 22, 1997 (JP) ..... 9-257015

(51) Int. Cl.[7] ..... G06G 7/00
(52) U.S. Cl. ..... 708/801
(58) Field of Search ..... 708/801, 670; 326/35–36

(56) References Cited

U.S. PATENT DOCUMENTS 5,917,742 * 6/1999 Ohmi et al. ..... 708/801
6,014,685 * 1/2000 Marshall et al. ..... 708/801

FOREIGN PATENT DOCUMENTS 60-68654 4/1985 (JP) ..... H01L/29/78
WO 90/13912 11/1990 (JP) ..... H01L/21/316
3-6679 1/1991 (JP) ..... G06F/15/82
WO 92/16971 10/1992 (JP) ..... H01L/29/788
5-335506 12/1993 (JP) ..... H01L/27/10
5-335656 12/1993 (JP) ..... H01L/49/00
WO 93/24958 12/1993 (JP) ..... H01L/27/10
6-53431 2/1994 (JP) ..... H01L/27/092
6-77427 3/1994 (JP) ..... H01L/27/10
6-112427 4/1994 (JP) ..... H01L/27/10
6-125049 5/1994 (JP) ..... H01L/27/10
6-139380 5/1994 (JP) ..... G06G/7/60
6-244375 9/1994 (JP) ..... H01L/27/10
6-250994 9/1994 (JP) ..... G06F/15/18
6-252744 9/1994 (JP) ..... H03K/19/21
07153924 6/1995 (JP) ..... H01L/27/10

(List continued on next page.)

*Primary Examiner*—Tan V. Mai
(74) *Attorney, Agent, or Firm*—Randall J. Knuth

(57) ABSTRACT

A semiconductor arithmetic circuit including 2 MOS (Metal Oxide Semiconductor) type transistors, the source electrodes of which are connected to one another and having gate electrodes connected to a signal line having a predetermined potential via switching elements, and having at least two input electrodes capacitively coupled with the gate electrodes, wherein a first voltage and second voltage are applied to, respectively, a first and second input electrode of a first MOS transistor. An input signal voltage is applied to both a first and second input electrode of a second MOS transistor, and then a second switching element is caused to conduct, and the gate electrodes are set to the signal line potential, then the second switching element is isolated and the gate electrodes are placed in an electrically floating state. The first voltage and the second voltage are inputted into, respectively, the first and second input electrodes of the second MOS type transistor, and the input signal voltage is inputted into the first and second input electrodes of the first MOS transistor, and thereby, the absolute value of the difference between a voltage determined in accordance with the first voltage and the second voltage and a coupling capacity ratio between the first and the second input electrodes with respect to the gate electrode, and a voltage determined by the input signal voltage and the coupling capacity ratio is calculated.

21 Claims, 14 Drawing Sheets

FOREIGN PATENT DOCUMENTS

| | | | |
|---|---|---|---|
| 07161942 | 6/1995 | (JP) | H01L/27/10 |
| WO 95/20268 | 7/1995 | (JP) | H03K/19/094 |
| 07200513 | 8/1995 | (JP) | G06F/15/18 |
| 07211084 | 8/1995 | (JP) | G11C/11/56 |
| 07226085 | 8/1995 | (JP) | G11C/11/56 |
| 07226912 | 8/1995 | (JP) | H04N/5/907 |
| WO 95/22145 | 8/1995 | (JP) | G11C/11/56 |
| 08084062 | 3/1996 | (JP) | H03K/19/0175 |
| 08195091 | 7/1996 | (JP) | G11C/16/06 |
| 08221504 | 8/1996 | (JP) | G06G/7/60 |
| 08274197 | 10/1996 | (JP) | H01L/21/8247 |
| WO96/30853 | 10/1996 | (JP) | G06G/7/12 |
| WO96/30854 | 10/1996 | (JP) | G06G/7/12 |
| WO96/30855 | 10/1996 | (JP) | G06G/7/60 |
| WO96/30948 | 10/1996 | (JP) | H01L/29/788 |
| 09244875 | 9/1997 | (JP) | G06F/7/50 |
| 09245110 | 9/1997 | (JP) | G06G/7/60 |

* cited by examiner

SEMICONDUCTOR ARITHMETIC CIRCUIT

BACKGROUND OF THE INVENTION AND DESCRIPTION OF THE RELATED ART

1. Technological Field

The present invention relates to a semiconductor arithmetic circuit, and in particular, relates to an arithmetic circuit which is capable of conducting rapid, highly accurate calculations with respect to analog and multivalue data.

2. Background Art

In recent years, in concert with advances in computer technology, striking progress has been made in data processing technology. However, where attempts have been made to conduct the flexible type of data processing of which human beings are capable, it has seemed essentially impossible to obtain an arithmetical result in real time using present day computers. A reason for this is that the data which human beings deal with in the course of their everyday lives are analog data, and firstly, there is enormous amount of such data, and additionally, these data are imprecise and unclear. The conversion of the entirety of an extremely large amount of analog data into digital values, and the conducting in serial fashion of strictly unique digital operations present problems for present day data processing systems.

Image processing is an example of this. For example, if a screen is rendered in terms of a 500×500 2-dimensional pixel array, the total number of pixels is 250,000, and if the intensity of the three colors red, green, and blue is expressed in 8 bit terms for each pixel, the amount of data required for one static screen image is 750,000 bytes. The amount of image data increase with time when the image is moving. Let us consider data processing in which, under these circumstances, a search is made, among an extremely large number of screens accumulated in the past, for that screen which is most similar to an incorporated screen. This type of processing may seem simple at first glance, but it is necessary to deal with the analog vectors which constitute the screen data, to calculate the distance between analog vectors, and to select the shortest distance. If an attempt is made to realize such processing using a computer, it is first necessary to convert all the analog vectors into digital vectors, and then to conduct arithmetical operations in serial fashion, so that even if a present day super computer is employed, it is impossible to manipulate this large amount of "1" and "0" data and to carry out screen recognition and analysis in real time. In order to overcome these problems, efforts have been made to realize data processing which is similar to that of human beings by inputting real world data in analog format in an unchanged manner, and conducting operations and processing in the analog format. This approach is most appropriate for real-time processing; however, this method has not yet been realized, and there exists at present no semiconductor arithmetic circuit which is capable of conducting such operations in real time and in a highly accurate manner.

OBJECT AND SUMMARY OF THE INVENTION

The present invention was created in light of the above circumstances; it has as an object thereof to provide a semiconductor arithmetic circuit which is capable of conducting operations at high speed and in a highly accurate manner, with respect to analog vectors.

The semiconductor arithmetic circuit of the present invention comprises a semiconductor arithmetic circuit comprising two MOS type transistors, the source electrodes of which MOS type transistors are connected to one another, and which have gate electrodes connected via switching elements to a signal line having a predetermined potential, and at least two input electrodes capacitively coupled with the gate electrodes, wherein a first voltage and a second voltage, respectively, are applied to the first and second input electrodes of the first MOS type transistor, the input signal voltage is applied to both the first and second input electrodes of the second MOS type transistor, and then, after the two switching elements have been caused to conduct and the gate electrodes have been set to the potential of the signal line, the two switching elements are isolated and the gate electrode are placed in an electrically floating state, and furthermore, the first voltage and the second voltage, respectively, are applied to the first and second input electrodes of the second MOS type transistor, while the input signal voltage is inputted into the first and second input electrodes of the first MOS type transistor, whereby the absolute value is calculated of the difference between a voltage determined by the first voltage, the second voltage, and the capacitive coupling ratio of the first and second input electrodes with respect to the gate electrodes, and a voltage determined by the input signal voltage and the capacitive coupling ratio.

In the present invention, it is not necessary to employ complicated control circuitry, and by providing switching elements at the gate electrode and switching over input, it is possible to conduct analog vector operations at high speed and with a high degree of accuracy.

BRIEF DESCRIPTION OF THE DIAGRAMS

DESCRIPTION OF THE REFERENCES

101, 102 NMOS transistors,
103, 104 gate electrodes,
105, 106 drains,
107 PMOS transistor,
108 signal line,

109, 110 sources,
111, 113, 115 NMOS transistors,
112, 114, 116 ground potentials,
117, 118, 119, 120 input electrodes,
121, 122, 123, 124, 125, 126, 127, 128 transmission gates having a CMOS structure,
129 input electrode,
130 ground potential,
131 power source potential,
301, 302 PMOS transistors,
303, 304 gate electrodes,
305, 306 drains,
307 NMOS transistor,
308 signal line,
309, 310 source electrode,
311, 313, 315, 312, 314, 316 ground potentials,
317, 318, 319, 320 input electrodes,
321, 322, 323, 324, 325, 326, 327, 328 transmission gates with CMOS structure,
329 input electrode,
330 ground potential,
331 power source potential,
401, 402, 403, 404, 405, 406, 407, 408, 409, 410 charge cancel transistors,
501, 502, 503, 504, 505, 506, 507, 508, 509, 510 charge cancel transistors,
601, 701 current sources,
801, 802, 803, 804, 805, 806 NMOS transistors,
807, 808, 809, 810, 811, 812 source electrodes,
813 NMOS transistor,
814 ground potential,
815 external capacity load,
816, 817, 818, 819, 820, 821 drain electrodes,
822 PMOS transistor,
823 power source potential,
824, 825, 826, 827, 828, 829, 830, 831, 832, 833, 834, 835 input terminals
901, 902, 904, 905, 906 PMOS transistors,
907, 908, 909, 910, 911, 912 source electrodes,
913 PMOS transistors,
914 power source potential,
915 external capacity load,
916, 917, 918, 919, 920, 921 drain electrodes,
922 NMOS transistor,
923 ground potential,
924, 925, 926, 927, 928, 929, 930, 931, 932, 933, 934, 935 input terminals,
1001, 1002, 1003, 1004 output electrodes,
1101, 1102, 1103, 1104 output electrodes.

DETAILED DESCRIPTION OF PREFERRED EMBODIMENTS OF THE INVENTION

Embodiments

Hereinbelow, embodiments of the present invention will be explained using the figures.

(Embodiment 1)

Figure 1:
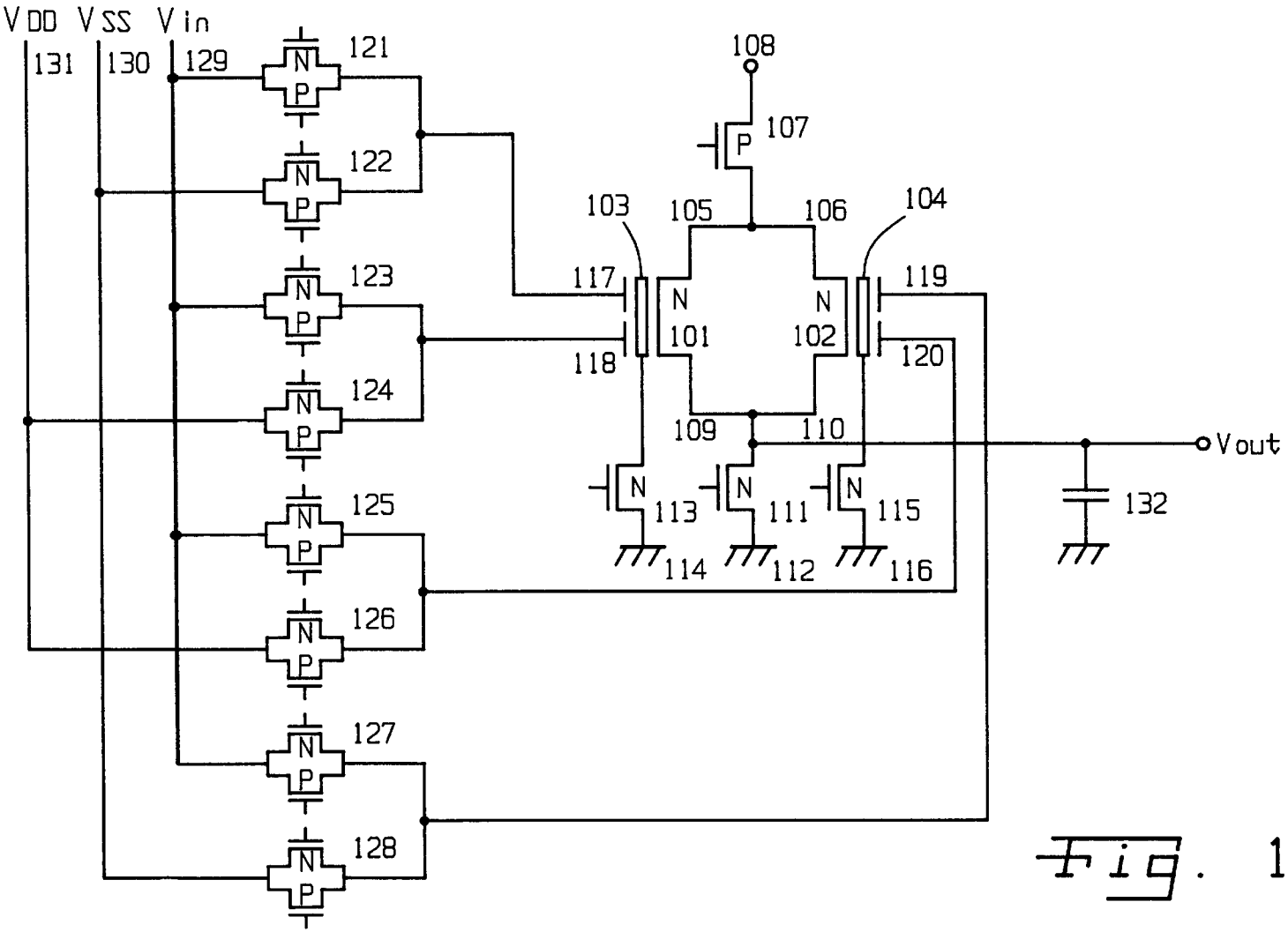
FIG. 1 is a circuit diagram relating to a first embodiment.

FIG. 1 is a circuit diagram showing a first embodiment.

References 101 and 102 indicate NMOS transistors, while references 103 and 104 indicate gate electrodes formed from, for example, $N^+$ polysilicon; gate electrode 103 controls the ON and OFF state of NMOS transistor 101, while gate electrode 104 controls the ON and OFF state of NMOS transistor 102.

The drains 105 and 106 of NMOS 101 and 102 are connected to one another, and these are connected to a signal line 108 of, here, 5V, via, for example, PMOS switch 107 as a switching element. On the other hand, the sources 109 and 110 of NMOS 101 and 102 are connected to one another, and these are connected to a ground potential 112 of, here, 0V, via NMOS 111 as a switching element. The gate electrode 103 of NMOS 101 is connected to a ground potential 114 of, here, 0V, via, for example, NMOS 113 as a switching element, and by means of using NMOS 113 as a switching element, it is possible to set the gate electrode 103 so as to be equal to a predetermined potential, and by means of placing NMOS 113 in an OFF state, it is possible to place this in an electrically floating state.

The gate electrode 104 of NMOS 102 is connected to a ground potential 116 of, here, 0V, via, for example, NMOS 115 as a switching element, and by means of employing NMOS 115 as a switching element, it is possible to set the gate electrode 104 to a predetermined potential, and by then further placing NMOS 115 in an OFF state, this may be placed in an electrically floating state. Input electrode 117 is capacitively coupled to gate electrode 103 of NMOS transistor 101 with a capacity of $C_1$, and input electrode 118 is capacitively coupled with a capacity of $C_2$, and furthermore, input electrode 119 is capacitively coupled with the gate electrode 104 of NMOS transistor 102 with a capacity of $C_3$, and input electrode 120 is capacitively coupled with a capacity of $C_4$. At this time, the relationship between the coupling capacities is such that, for example, $C_1/C_2=C_3/C_4$.

In the present embodiment, the first voltage is set to the power source voltage ($V_{DD}$), while the second voltage is set to the ground voltage ($V_{SS}$); however, these are not necessarily so limited.

Input electrode 117 is connected to input electrode 129 with, for example, a CMOS structure transmission gate 121 as a switching element, and furthermore, input electrode 117 is connected to, for example, ground potential 130 with, for example, a CMOS structure transmission gate 122 as a switching element. Input electrode 118 is connected to input electrode 129 with, for example, a CMOS structure transmission gate 123 as a switching element, and furthermore, the input electrode 118 is connected to a power source potential 131 with, for example, a CMOS structure transmission gate 124 as a switching element. Input electrode 119 is connected to the input electrode 129 with, for example, a CMOS structure transmission gate 125 as a switching element, and furthermore, input electrode 119 is connected to, for example, the ground potential 130 with, for example, a CMOS structure transmission gate 126 as a switching element. Input electrode 120 is connected to input electrode 129 with, for example, a CMOS structure transmission gate 127 as switching element, and furthermore, input electrode 120 is connected to power source potential 131 with, for example, a CMOS structure transmission gate 128 as a switching element. Here, the CMOS structure transmission gates 121, 122, 123, 124, 125, 126, 127, and 128 were employed as switching elements in order to connect input electrodes 117, 118, 119, and 120 with input electrode 129, ground potential 130, and power source potential 131; however, these were only employed so as to permit accurate operation of the semiconductor arithmetic circuit, and there will be no change in the effects of the present invention if other switching elements are used in place of the CMOS structure transmission gates 121, 122, 123, 124, 125, 126, 127, and 128.

Furthermore, the sources 109 and 110 of NMOS transistors 101 and 102 are connected to, for example, an external capacity load 132, and the structure is such that the higher potential among the potential $V_{FG1}$ of the gate electrode 103 and the potential $V_{FG2}$ of the gate electrode 104 may be read out as Vout in the manner of a source follower circuit. Here, Vout is the higher of $V_{FG1}-V_{TH1}$ and $V_{FG2}-V_{TH2}$; $V_{TH1}$ is the threshold voltage as viewed from the gate electrode 103 of NMOS 101, while $V_{TH2}$ is the threshold voltage as viewed from gate electrode 104 of NMOS 102. For example, if $V_{TH1}=V_{TH2}=0V$ is set, then Vout will be the higher of the two voltages $V_{FG1}$ and $V_{FG2}$. Here, for the purposes of simplicity, $V_{TH1}=V_{TH2}=0V$ is set; however, no problem will be caused with respect to the present invention even if a value other than 0V is selected.

Here, the output potential Vout may be obtained by placing the NMOS transistor 111 in an OFF state. At this time, the output potential Vout was 0V when the NMOS transistor 111 was in an ON state; however, this begins to increase from 0V once the NMOS transistor 111 has been placed in an OFF state, and the respective differences in potential between the respective gate electrodes and the respective sources of the NMOS transistors 101 and 102 reach the threshold value, and the potential increases until both of the NMOS transistors 101 and 102 enter an OFF state, so that effectively, a voltage which is the higher of $V_{FG1}$ and $V_{FG2}$ is outputted as output potential Vout.

Here, the drains 105 and 106 of NMOS transistors 101 and 102 are connected to one another, and setting is conducted in order to prevent the flow of current from the 5V signal line 108 via PMOS transistor 107 as a switching element and in order to restrict the power consumption. Accordingly, there is no change in the effects of the present invention even if another switch is used in place of transistor 107.

Furthermore, a resistor or capacitor may be employed in place of the switching element of PMOS transistor 107, or alternatively, even if nothing is used and the drains 105 and 106 of NMOS transistors 101 and 102 are directly connected to the 5V signal line 108, there is no change in the effects of the present invention. Furthermore, it is not particularly necessary that drains 105 and 106 be connected to one another; no problems will be caused if these are separately connected to the 5V signal line 108 using mechanisms such as those described above. Here, it was merely for the purposes of facilitating circuit design that drains 105 and 106 were connected to one another.

Next, the operation of the circuit will be explained.

The potential (Vin) of input electrode 129 is first inputted, via the CMOS structure transmission gates 121 and 123, into input electrodes 117 and 118 which are capacitively coupled with the gate electrode 103 of NMOS transistor 101, and the potential ($V_{SS}$) of the ground potential 130 is inputted, via the CMOS structure transmission gate 128, into input electrode 119, which is capacitively coupled with the gate electrode 104 of NMOS transistor 102, and the potential ($V_{DD}$) of the power source potential 131 is inputted into input electrode 120 via the CMOS structure transmission gate 126. At this time, by making NMOS transistors 113 and 115 conductive, gate electrodes 103 and 104 are set so as to be equal to the ground potential of, for example, 0V. Additionally, prior to isolating the switching elements 121, 123, 126, and 128 which are currently conducting, the NMOS transistor switching elements 113 and 115, which are currently conducting, are isolated, and the gate electrodes 103 and 104 are placed in an electrically floating state.

After this, the conducting switching elements 121, 124, 126, and 128 are isolated, and additionally, switching elements 122, 124, 125, and 127 are caused to conduct, and the potential of input electrode 117 is set equal to the ground potential ($V_{SS}$), the potential of input electrode 118 is set equal to the power source potential ($V_{DD}$), the potential of input electrode 119 is set equal to the potential (Vin) of input electrode 129, and the potential of input electrode 120 is set equal to the potential (Vin) of input electrode 129. In other words, gate electrodes 103 and 104 are initially set equal to the ground potential, input electrodes 117 and 118 are set equal to the potential of input electrode 129, the potential of input electrode 119 is set equal to the ground potential of ground electrode 130, and input electrode 120 is set equal to the power source potential of power source potential 131. Then, after the gate electrodes have been placed in an electrically floating state, input electrodes 117, 118, 119, and 120 are switched from the initial state, and these are set equal to, respectively, the ground potential ($V_{SS}$), the power source potential ($V_{DD}$), the input potential (Vin), and the input potential (Vin).

Here, the potential of input electrodes 117 and 118 is first set equal to the input potential (Vin) of the input electrode 129, the potential of input electrode 119 is set to the ground potential, and the potential of input electrode 120 is set to the power source potential. However, it is of course the case that no problems will be occasioned if the order of input into input electrode 117, 118 and 119 and 120 is opposite to that which is described above. The central character of the operation of this circuit is that when input is conducted into input electrodes 117, 118, 119, and 120, the first input and second input are switched.

Here, the explanation will center on the voltage which is expressed when the ground potential ($V_{SS}$) of the ground electrode 130 is inputted into the input electrode 117 and the power source potential ($V_{DD}$) of the power source electrode 131 is inputted into the input electrode 118. As described above, by means of the capacity $C_1$, the input electrode 117 is capacitively coupled to the gate electrode 103, and by means of the capacity $C_2$, input electrode 118 is capacitively coupled to the gate electrode 103. If the voltage which appears when the ground potential and the power source potential are applied to the respective electrodes is represented by $V_m$, then this voltage is expressed by the capacitive coupling ratio of the input electrodes, $$V_m=(C_1 \cdot V_{SS}+C_2 \cdot V_{DD})/(C_1+C_2).$$

Furthermore, this can expressed in the same manner with respect to the input electrode 119 which is coupled using capacity $C_3$ and the input electrode 120 which is coupled using capacity $C_4$, and the following results:

$$V_m=(C_3 \cdot V_{SS}+C_4 \cdot V_{DD})/(C_3+C_4)$$

Here, as described above, the capacitive coupling ratio between the input electrode 117 and the input electrode 118 and the capacitive coupling ratio between input electrode 119 and input electrode 120 are identical, and this can be expressed in a formula as $C_1/C_2=C_3/C_4$.

Furthermore, here, the ground potential is applied to input electrode 117 and input electrode 119, while the power source potential is inputted into input electrode 118 and input electrode 120; however, it is of course the case that there will be no change in the effects of the present invention if this order is reversed. The reason for this is that the essential feature of this circuit is that a value is determined which is expressed by the respective capacitive coupling ratios between input electrodes 117 and 118 and between input electrodes 119 and 120.

After the input has been switched, the potential of gate electrode 103 becomes $V_m$−Vin while the potential of gate electrode 104 becomes Vin−$V_m$. The reason for this is that, since the gate electrodes 103 and 104 were placed in an electrically floating state prior to switching the inputs, when the inputs are switched, the gate electrodes 103 and 104 are increased by the difference between the potential which was originally inputted and the potential which was subsequently inputted. By means of this, the difference is obtained between the two inputs.

When the output operation commences, as described above, by placing the NMOS transistor 111 in an OFF state, the larger of the potential (Vin−$V_m$) of gate electrode 103 and the potential ($V_m$−Vin) of gate electrode 104 is outputted. By means of this, the difference between the inputs is obtained, and it is possible to output the larger of the results, so that the largest value is detected. The ultimate output result Vout can be expressed in terms of a formula as |Vin−$V_m$|.

Here, the ratio between the coupling capacity $C_1$ of the input electrode 117 and the coupling capacity $C_2$ of the input electrode 118 is set to 6:10, and the ratio of the coupling capacity $C_3$ of input electrode 119 and the coupling capacity $C_4$ of input electrode 120 is set to 6:10. Furthermore, the input potential of input electrode 129 will be considered to be 2V, while the ground potential of ground electrode 130 will be considered to be 0V, and the power source potential of power source electrode 131 will be considered to be 5V. At this time, the voltage expressed by the coupling capacity ratio $C_1$:$C_2$ and $C_3$:$C_4$ is 3.125V in accordance with the formula described above. First, the potential 2V of input electrode 129 is inputted into input electrode 117 by causing the switching element 121 to conduct, and the potential 2V of the input electrode 129 is inputted into input electrode 118 by causing switching element 123 to conduct. Furthermore, the potential 0V of the ground electrode is inputted into input electrode 119 by causing switching element 128 to conduct, and the potential 5V of the power source electrode 131 is inputted into input electrode 120 by causing switching element 126 to conduct, and thereby, an analog voltage of 3.125V is expressed.

At this time, the gate electrodes 103 and 104 are set equal to the ground potential 0V by causing NMOS transistors 113 and 115, respectively, to conduct.

After the passage of 10 nanoseconds, NMOS transistors 113 and 115 are isolated, gate electrode 103 and 104 are placed in an electrically floating state, and gate electrodes 103 and 104 are maintained at the ground potential of 0V. Then, after the passage of 2 nanoseconds, switching elements 121, 123, 126, and 128 are placed in an OFF state, and switching elements 122, 124, 125, and 127 are placed in an ON state, and thereby, the potential 2V of the input electrode 129 is inputted into input electrodes 119 and 120, the ground potential 0V of ground electrode 130 is inputted into input electrode 117, and the power source potential 5V of the power source electrode 131 is inputted into input electrode 118.

At this time, the potential of gate electrode 103, into which 2V was originally inputted, next experiences an input of 3.125V, and thereby, the potential of gate electrode 103 is increased by the difference thereof, 1.125V. On the other hand, the potential of the gate electrode 104, which was originally inputted as 3.125V, next experiences an input of 2V, and the potential of gate electrode 104 is reduced by the difference therebetween of 1.125V, and becomes −1.125V. However, in actuality, the PN junctions comprising the NMOS transistor 115 are order biased, so that there can only be a potential fall of the built in potential from 0V; however, this does not present a problem in the circuitry.

Finally, in the output operation, the NMOS transistor 111 is placed in an OFF state, while PMOS 107 is placed in an ON state, and thereby, NMOS transistors 101 and 102 operate in the manner of a source follower circuit, and the potential of 1.125V of the gate electrode 103, which stores the larger of the potential of gate electrodes 103 and 104, is outputted.

Figure 2:
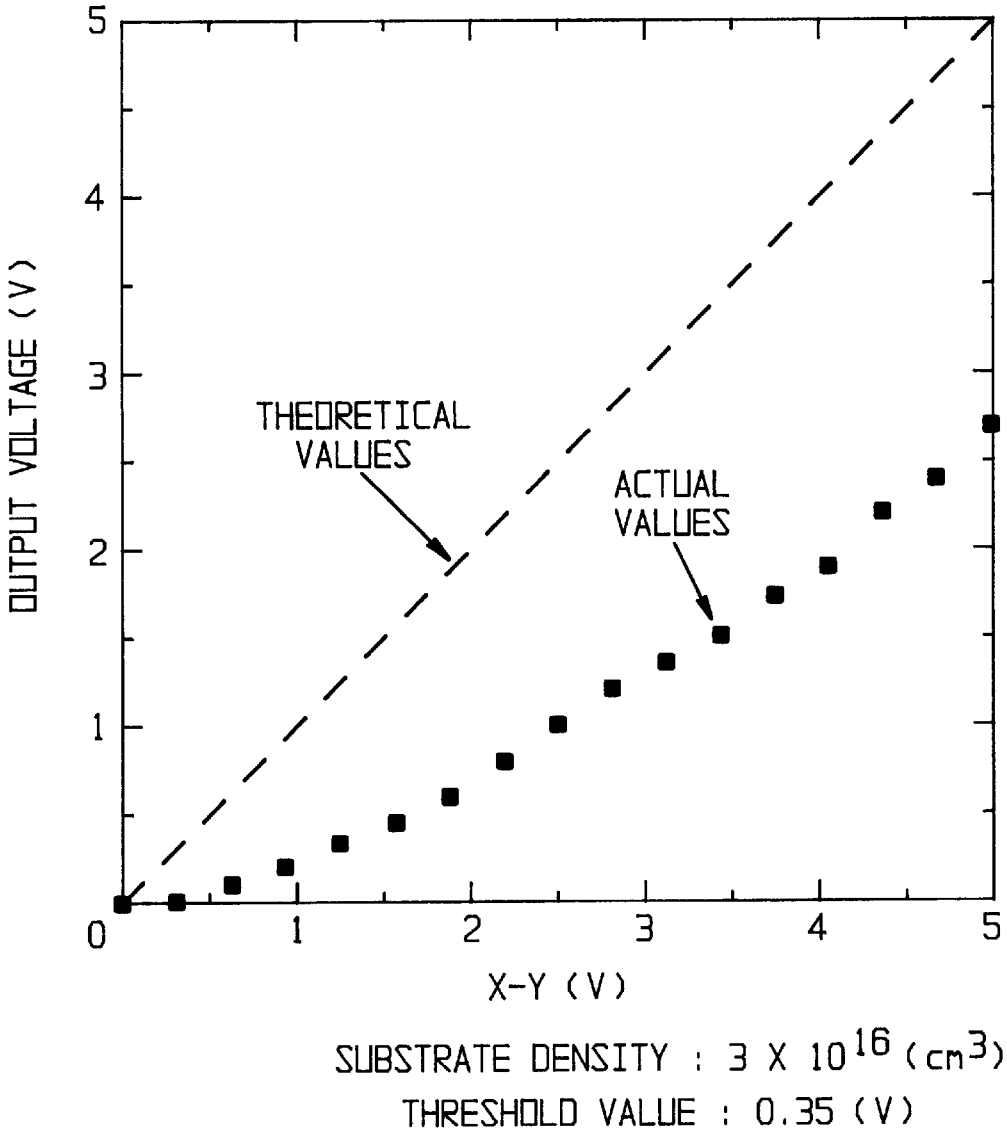
FIG. 2 shows the measured results of a test circuit relating to the first embodiment.

A test circuit was actually constructed for this example and measurements were conducted. The results thereof are shown in FIG. 2. 17 different ratios of the capacities coupled to the gate electrode were produced in FIG. 2, and measurements were conducted with respect to the other examples in addition to the example described above. As a result of variations in the threshold value of the transistors or other parameters as a result of the process conditions of the test circuit production, the |Vin−Vm| formula was not completely satisfied and a coefficient was applied; however, it can be seen that a circuit was obtained which operated correctly in terms of the overall characteristics. It was learned that by means of controlling the process conditions and the threshold values of the transistors, it is possible to obtain more accurate characteristics. It can be seen from FIG. 2 that the operation was clearly correct with respect to all examples.

Here, as a concrete example, the potential of input electrode 129 was set to 2V, the potential of ground electrode 130 was set to 0V, and the potential of the power source electrode 131 was set to 5V; however, it is of course the case that calculations are possible with freely selected analog values. Furthermore, the ratio of the coupling capacities ($C_1$, $C_2$) of input electrodes 117 and 118 which were capacitively coupled with gate electrode 103 was set to 6:10, and the ratio of the coupling capacities ($C_3$, $C_4$) of input electrodes 119 and 120 which were capacitively coupled with gate electrode 104 was set to 6:10; however, it is of course the case that operations are possible with freely selected ratios.

Here, NMOS transistors 111, 113, and 115 were employed as switching elements; however, no problems will be caused if other switching elements are employed, such as PMOS transistors, or CMOS structure transmission gates or the like. Furthermore, NMOS transistors were used here as the switching elements; however, in place of switching elements, resistors or capacitors may be used, and this will cause no problems. Furthermore, the ground potential 112 was here set to a level of 0V in order to facilitate circuit design; however, there will be no change in the effects of the present invention if a voltage other than 0V is used for the ground potential.

Furthermore, two input electrodes were capacitively coupled to gate electrodes 103 and 104, and an analog voltage was expressed by the ratio thereof; however, the number of input electrodes capacitively coupled to the gate electrodes may be set to a freely selected number, and by applying appropriate potentials to these input electrodes, it is possible to express a freely selected analog voltage, and it is also possible to obtain the absolute value of the difference between input signals.

As described above, in the circuit of the present invention, the inputs are switched, an analog voltage is expressed by the capacitive coupling ratio of the input terminals capacitively coupled with the gate electrodes, and switching elements 113 and 115 are attached to gate electrodes 103 and 104, and gate electrodes 103 and 104 are ultimately set to the ground potential and placed in an electrically floating state, and thereby, it is possible to obtain differences with respect to inputted data, and it is possible to select the largest results among these differences, so that a circuit is realized which is capable of obtaining the absolute value of the difference between inputted data in a highly accurate manner in real time.

Currently, in order to conduct data processing in which the difference is obtained between inputted data expressed in analog values and only the largest value among the results is selected in this manner, it is first necessary to subject the analog data to A/D conversion, and then to conduct an extremely large number of 4-rules operations by means of a computer, so that it is impossible to produce a result in real time. However, by using the semiconductor arithmetic circuit of this invention, it is possible to realize this using the simple circuitry shown in FIG. 1, and it is moreover possible to conduct operations at high speed. Accordingly, the present invention is extremely important in that it realizes something which was heretofore unrealizable.

(Embodiment 2)

Figure 3:
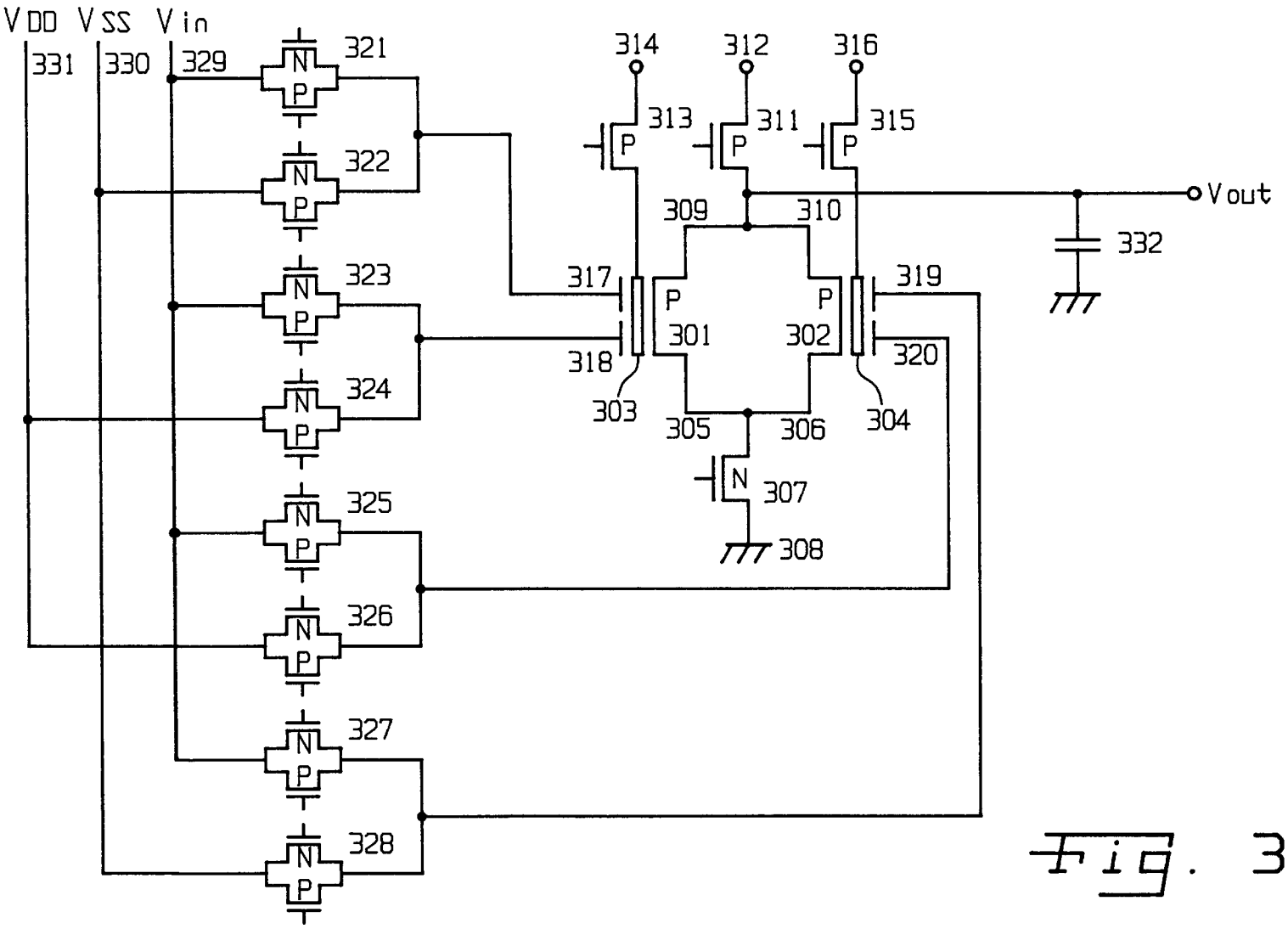
FIG. 3 is a circuit diagram relating to a second embodiment.

FIG. 3 is a circuit diagram showing a second embodiment.

References 301 and 302 indicate PMOS transistors, while references 303 and 304 indicate gate electrodes formed from, for example, N+ polysilicon; gate electrode 303 controls the ON and OFF state of PMOS transistor 301, while gate electrode 304 controls the ON and OFF state of PMOS transistor 302.

The drains 305 and 306 of PMOS transistors 301 and 302 are connected to one another, and these are connected to a signal line 308 of, here, 5V, via, for example, NMOS switch 307 as a switching element. On the other hand, the source electrodes 309 and 310 of PMOS transistors 301 and 302 are connected to one another, and these are connected to a ground potential 312 of, here, 0V, using PMOS 311 as a switching element. The gate electrode 303 of PMOS 301 is connected to a ground potential 314 of, here, 0V, using, for example, PMOS transistor 313 as a switching element, and by means of using PMOS transistor 313 as a switching element, it is possible to set the gate electrode 303 to a predetermined potential, and additionally, by means of placing PMOS transistor 313 in an OFF state, it is possible to make this electrically floating.

The gate electrode 304 of PMOS 302 is connected to a ground potential 316 of, here, 0V, using, for example, PMOS transistor 315 as a switching element, and by means of using PMOS transistor 315 as a switching element, it is possible to set the gate electrode 304 to a predetermined potential, and additionally, by placing PMOS transistor 315 in an OFF state, it is possible to make this electrically floating. An input electrode 317 is capacitively coupled with the gate electrode 303 of PMOS transistor 301 using a capacity $C_1$, and an input electrode 318 is similarly capacitively coupled using a capacity $C_2$, and furthermore, an input electrode 319 is capacitively coupled to the gate electrode 304 of the PMOS transistor 302 using a capacity $C_3$, while an input electrode 320 is capacitively coupled using a capacity $C_4$. At this time, the relationship between the coupling capacities is such that, for example, $C_1/C_2=C_3/C_4$.

Input electrode 317 is connected to input electrode 329 using, for example, a CMOS structure transmission gate 321 as a switching element, and furthermore, input electrode 317 is connected to, for example, a ground potential 330 using, for example, a CMOS structure transmission gate 322 as a switching element. Input electrode 318 is connected to input electrode 329 using, for example, a CMOS structure transmission gate 323 as a switching element, and furthermore, input electrode 318 is connected to, for example, a power source 331 using, for example, a CMOS structure transmission gate 324 as a switching element. Input electrode 319 is connected to input electrode 329 using, for example, a CMOS structure transmission gate 325 as a switching element, and furthermore, input electrode 319 is connected to, for example, the ground potential 330 using, for example, a CMOS structure transmission gate 326 as a switching element. Input electrode 320 is connected to input electrode 329 using, for example, a CMOS structure transmission gate 327 as a switching element, and furthermore, input electrode 320 is connected to a power source potential 331, using, for example, a CMOS structure transmission gate 328 as a switching element. Here, the CMOS structure transmission gates 321, 322, 323, 324, 325, 326, 327, and 328 were employed as switching elements in order to connect the input electrodes 317 and 318, and 319 and 320, with input electrode 329, the ground potential 330 and the power source potential 331; however, these were only used in order to permit the accurate operation of the semiconductor arithmetic circuit, and there will be no change in the effects of the present invention if other switching elements are used in place of the CMOS structure transmission gates 321, 322, 323, 324, 325, 326, 327, and 328.

Furthermore, the sources 309 and 310 of PMOS transistors 301 and 302 are connected to, for example, an external capacity load 332, and the potential which is lower among the potential $V_{FG1}$ of the gate electrode 303 and the potential $V_{FG2}$ of the gate electrode 304 can be read out to the exterior as Vout in the manner of a source follower circuit. Here, Vout is the higher of the voltages $V_{FG1}-V_{TH1}$ and $V_{FG2}-V_{TH2}$, where $V_{TH1}$ is the threshold voltage as seen from the gate electrode 303 of PMOS 301, while $V_{TH2}$ is the threshold voltage as seen from gate electrode 304 of PMOS 302. If setting is conducted such that, for example, $V_{TH1}=V_{TH2}=0V$, then Vout will be the lower of the voltages $V_{FG1}$ and $V_{FG2}$ Here, for the purposes of simplicity, $V_{TH1}=V_{TH2}=0V$ is set, but no problems will be caused to the results of the present invention if a value other than 0V is used.

The output potential Vout will be obtained by placing, here, the PMOS transistor 311 in an OFF state. At this time, the output potential Vout was 0V when PMOS transistor 311 was in an ON state; however, by placing PMOS transistor 311 in an OFF state, the potential begins to increase from 0V, and the differences in potential between the respective gate electrodes and the respective sources of PMOS transistors 301 and 302 reach the threshold values, the potential continues to decrease until both of the PMOS transistors 301 and 302 have entered an OFF state, so that as a result, the lower of the voltages $V_{FG1}$ and $V_{FG2}$ is outputted as output voltage Vout.

Here, the drains 305 and 306 of PMOS transistors 301 and 302 are connected to one another, and setting is conducted so as to prevent the flow of a current to the ground potential 308 of 0V via NMOS transistor 307 as a switching element, and in order to suppress power consumption. Accordingly, there is no change in the effects of the present invention even if other switches are employed in place of transistor 307.

Furthermore, a resistor or a capacitor may be used in place of the switching element of NMOS transistor 307, or alternatively, nothing may be employed, and the drain 305 and 306 of PMOS transistors 301 and 302 may be directly connected to ground potential 308, without changing the effects of the present invention. Furthermore, it is not particularly necessary to connect drains 305 and 306; no problems will be caused if these are independently connected to the 0V ground potential 308 using the mechanisms described above. Here, drains 305 and 306 were connected to one another solely to facilitate circuit design.

Next, the operation of this circuit will be explained.

The potential (vin) of input electrode 323 is initially inputted into the input electrodes 317 and 318 which are capacitively coupled to the gate electrode 303 of PMOS transistor 301, via the CMOS structure transmission gates 321 and 323, and the potential ($V_{SS}$) of the ground potential 330 is inputted into the input electrode 319, which is capacitively coupled to the gate electrode 304 of PMOS transistor 302, via the CMOS structure transmission gate 328, and the potential ($V_{DD}$) of the power source potential 131 is inputted into input electrode 320 via the CMOS structure transmission gate 326. At this time, by means of causing the PMOS transistors 313 and 315 to conduct, the gate electrodes 303 and 304, respectively, are set equal to a ground potential of, for example, 0V. Then, prior to isolating the currently conducting switch elements 321, 323, 326, and 328, the PMOS transistor switch elements 313 and 315, which are currently conducting, are isolated, and the gate electrodes 303 and 304 are placed in an electrically floating state.

After this, the conducting switch elements 321, 324, 326, and 328 are isolated, and along with this, the switch elements 322, 324, 325, and 327 are caused to conduct, and the potential of input electrode 317 is set equal to the ground potential ($V_{SS}$), the potential of the input electrode 318 is set equal to the power source potential ($V_{DD}$), the potential of the input electrode 319 is set equal to the potential (Vin) of the input electrode 329, and the potential of input electrode 320 is set equal to the potential (Vin) of the input electrode 329. In other words, the gate electrodes 303 and 304 are initially set equal to the ground potential, the input electrodes 317 and 318 are set equal to the potential of input electrode 329, the input electrode 319 is set equal to the ground potential of the ground electrode 330, and the input electrode 320 is set equal to the power source potential of power source potential 331. Then, after placing the gate electrodes in an electrically floating state, the initial states of input electrodes 317, 318, 319, and 320 are switched, and these are set equal to, respectively, the ground potential ($V_{SS}$), the power source potential ($V_{DD}$), and the input potential (Vin). Here, the potential of input electrodes 317 and 318 is first set equal to the input potential (Vin) of the input electrode 329, and the potential of input electrode 319 is set equal to the ground potential, while the potential of input electrode 320 is set equal to the power source potential. However, it is of course the case that no problems will be caused if the order of input into input electrodes 317, 318, 319, and 320 is the opposite of that described above. The reason for this is that the essentials of the operation of this circuit are that, when input is conducted into input electrodes 317 and 318, and 319 and 320, switching is conducted between the first and second inputs.

Here, an explanation will be given with respect to voltage which is expressed when the ground potential ($V_{SS}$) of ground electrode 330 is inputted into input electrode 317, and the power source potential ($V_{DD}$) of power source electrode 331 is inputted into input electrode 318. As described above, input electrode 317 is capacitively coupled with gate electrode 303 by a capacity $C_1$, while input electrode 318 is capacitively coupled with the gate electrode 303 via a capacity $C_2$. If the voltage expressed when the ground potential and power source potential are applied to the various electrodes is represented by $V_m$, then this voltage is expressed in terms of the capacitive coupling ratio between the input electrodes, and is expressed by the following formula:

$$V_m=(C_1 \cdot V_{SS}+C_2 \cdot V_{DD})/(C_1+C_2)$$

Furthermore, this can be expressed in a similar way with respect to the input electrode 319 which is coupled via a capacity $C_3$ and the input electrode 320 which is coupled via a capacity $C_4$, and this results in: $V_m=(C_3 \cdot V_{SS}+C_4 \cdot V_{DD})/(C_3+C_4)$. Here, as described above, the capacitive coupling ratio between input electrode 317 and input electrode 318 is identical to the capacitive coupling ratio between input electrode 319 and input electrode 320, and this may be expressed in a formula as $C_1/C_2=C_3/C_4$. Furthermore, here, the ground potential was applied to input electrode 317 and input electrode 319, while the power source potential was applied to input electrode 318 and input electrode 320; however, it is of course the case that the effects of the present invention will be unchanged even if this order is reversed. The reason for this is that the essentials of the present circuit are that expression is conducted in terms of the capacitive coupling ratios between input electrodes 317 and 318 and input electrodes 319 and 320, respectively.

After the input has been switched, the potential of gate electrode 303 is $V_{DD}+V_m-Vin$, while the potential of gate electrode 304 is $V_{DD}+Vin-V_m$. The reason for this is that, because the gate electrodes 303 and 304 were placed in an electrically floating state prior to the switching of the input, when the input is switched, the potential of gate electrodes 303 and 304 increases from $V_{DD}$ by the amount of the difference in potential between the potential which was initially inputted and the potential which was subsequently inputted. By means of this, the difference is obtained with respect to the inputs, and the results thereof are subtracted from $V_{DD}$.

When the output operation commences, as described above, by placing the PMOS transistor 311 in an OFF state, the larger of the potential ($V_{DD}+V_m-Vin$) of gate electrode 303 and the potential ($V_{DD}+Vin-V_m$) of gate electrode 304 is outputted. By means of this, the difference is obtained with respect to the outputs, and the larger potential among these results is outputted. By means of this, after the difference has been obtained with respect to the inputs, this is taken from $V_{DD}$, and among the results, the smaller value can be outputted, so that the smallest value is detected. Additionally, the ultimate output result Vout may be expressed in terms of a formula as $|V_{DD}-(Vin-V_m)|$.

Here, the ratio of the coupling capacity $C_1$ of the input electrode 317 and the coupling capacity $C_2$ of the input electrode 318 is set to 6:10, and the ratio of the coupling capacity $C_3$ of the input electrode 319 and the coupling capacity $C_4$ of the input electrode 320 is also set to 6:10. Furthermore, the input potential of input electrode 329 will be considered to be 2V, while the ground potential of ground electrode 330 will be considered to be 0V, and the power source potential of power source electrode 331 will be considered to be 5V. At this time, the voltage expressed by the coupling capacity ratios $C_1$:$C_2$ and $C_3$:$C_4$ is 3.125V in accordance with the formula described above. First, by causing the switching element 321 to conduct, the potential 2V of the input electrode 329 is inputted into input electrode 317, and by causing the switching element 323 to conduct, the potential 2V of the input electrode 329 is inputted into input electrode 318. Furthermore, by causing the switching elements 328 to conduct, the potential 0V of ground electrode 330 is inputted into input electrode 319, and by causing switching element 326 to conduct, the potential 5V of the power source electrode 331 is inputted into input electrode 320, and thereby, analog voltage of 3.125V is expressed.

At this time, by causing the PMOS transistors 313 and 315 to conduct, the gate electrodes 303 and 304 are set equal to the ground potential 0V.

After the passage of 10 nanoseconds, the PMOS transistors 313 and 315 are isolated, and the gate electrodes 303 and 304 are placed in an electrically floating state, and the gate electrodes 303 and 304 are maintained at the power source potential of 5V. Then, after the passage of 2 nanoseconds, switching elements 321, 323, 326, and 328 are placed in an OFF state, and switching elements 322, 324, 325, and 327 are placed in an ON state, and thereby, the potential 2V of the input electrode 329 is inputted into input electrodes 319 and 320, the ground potential 0V of ground electrode 330 is inputted into input electrode 317, and the power source potential 5V of power source electrode 331 is inputted into input electrode 318.

At this time, a potential of 2V was initially inputted into gate electrode 303, and subsequently, a potential of 3.125V is inputted, and thereby, the potential of gate electrode 303 is increased by the difference therebetween, 1.125V, and becomes 6.125V. On the other hand, a potential of 3.125V was initially inputted into gate electrode 304, and subsequently, 2V is inputted, and thereby, the potential of gate electrode 304 declines by the difference therebetween, 1.125V, and becomes 3.875V. However, in actuality, the PN junctions comprising the PMOS transistor 315 are order biased, so that this increases only up to the built into potential from 5V, and does not present a problem in the circuitry.

Finally, in the output operation, the PMOS transistor 311 is placed in an OFF state, and the NMOS transistor 307 is placed in an ON state, and thereby, PMOS transistors 301 and 302 operate in the manner of a source follower circuit, and the potential of 3.875V of gate electrode 303, which stores the smaller of the potentials of gate electrodes 303 and 304, is outputted.

Here, as a concrete example, the potential of input electrode 329 was 2V, the potential of ground electrode 330 was 0V, and the potential of power source electrode 331 was 5V; however, it is of course the case that operations are possible with freely selected analog values. Furthermore, the ratio of the coupling capacities ($C_1$, $C_2$) of input electrodes 317 and 318 which are capacitively coupled with gate electrode 303 was set to 6:10, and the ratio of the coupling capacities ($C_3$, $C_4$) of input electrodes 319 and 320, which are capacitively coupled with gate electrode 304, was set to 6:10; however, it is of course the case that operations are possible with freely selected ratios.

Here, PMOS transistors 311, 313, and 315 were used as switching elements; however, no problems will be caused if other switching elements are used in their place, such as NMOS transistors, CMOS structure transmission gates, or the like. Furthermore, with respect to the PMOS transistors, these were used as switching elements; however, resistors or capacitors may be used in place of the switching elements without causing any problems. Furthermore, the ground potential 312 was set to 0V in order to facilitate circuit design; however, there will be no change in the effects of the present invention even if a voltage other than 0V is used as the ground potential.

Furthermore, two input electrodes were capacitively coupled to the gate electrodes 303 and 304, and the analog voltage was expressed by the ratio therebetween; however, a freely selected member of input electrodes may be capacitively coupled to the gate electrodes, and by applying an appropriate potential to the input electrodes, it is possible to express a freely selected analog voltage, and it is possible to calculate the absolute value of the difference thereof with an input signal.

As described above, in the present circuit, by switching the inputs, expressing an analog voltage by means of the capacitive coupling ratio between input terminals capacitively coupled to gate electrodes, appending switching elements 313 and 315 to gate electrodes 303 and 304 and alternately setting the gate electrodes 303 and 304 to the power source potential and placing them in an electrically floating state, it is possible to obtain the difference between inputted data and to subtract this from $V_{DD}$, and furthermore, it is possible to select the smallest value among the results, so that a circuit is realized which is ultimately capable of calculating agreement with inputted data with a high degree of accuracy.

Presently, in order to conduct data processing in which the degree of agreement between inputted data expressed in terms of analog values is obtained, and the data having the highest degree of agreement are selected, it is first necessary to conduct the A/D conversion of the analog data, and to then to conduct an enormous number of 4-rules operations by means of a computer, so that it is impossible to obtain a result in real time. However, if the semiconductor arithmetic circuit of the present invention is employed, it is possible to realize this with simple circuitry such as that shown in FIG. 3, and it is moreover possible to conduct operations at high speed. Accordingly, the present invention is extremely important in that it permits the realization of something which was heretofore unrealizable.

(Embodiment 3)

Figure 4:
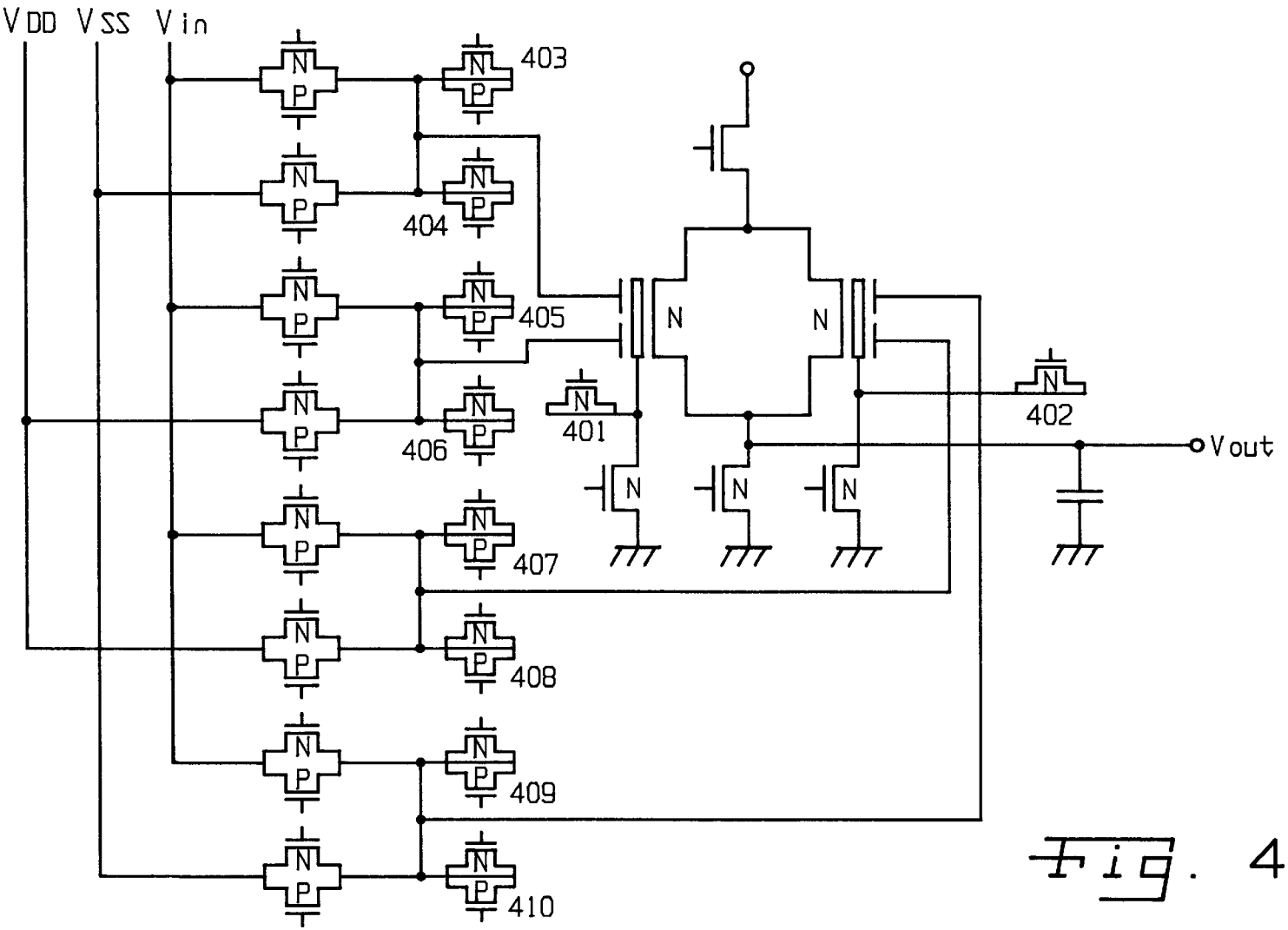
FIG. 4 is a circuit diagram relating to a third embodiment.

FIG. 4 is a circuit diagram showing a third embodiment. This embodiment has almost the same structure of that of the first embodiment. Accordingly, only those parts of the structure which are different, and the operating principle, will be explained.

The change cancel transistor 401 is an NMOS transistor; the source and drain thereof are directly connected. In addition, the charge cancel transistor 401 is connected to the gate electrode of NMOS transistor 101. Here, the gate width of the charge cancel transistor 401 is set so as to be half the gate width of the NMOS transistor 113, and the other conditions are completely identical.

With respect to the operation, when the NMOS transistor 113 is in an ON state, the charge cancel transistor is in an OFF state, while when the NMOS transistor 113 is in an OFF state, the charge cancel transistor 401 is in an ON state. In other words, the structure is such that the ON state and OFF state are opposite to one another.

Here, the charge cancel transistor 402 is an NMOS transistor, and the source and drain thereof are directly connected to one another. Additionally, the charge cancel transistor 402 is connected to the gate electrode of the NMOS transistor 102. Here, the gate width of this charge cancel transistor 402 is set so as to be half the gate width of the NMOS transistor 115, and the other conditions are set so as to be identical.

With respect to the operation, when the NMOS transistor 115 is in an ON state, the charge cancel transistor 402 is in an OFF state, and when the NMOS transistor 115 is in an OFF state, the charge cancel transistor 402 is in an ON state. In other words, the ON state and OFF state are opposite to one another.

The charge cancel transistor 403 is a CMOS structure transmission gate in which the source and drain of the NMOS and PMOS are connected to one another, and this charge cancel transistor 403 is connected to the input electrode 117. With respect to this charge cancel transistor 403, the gate width of the PMOS and NMOS is set so as to be half the gate width of the PMOS and NMOS of the CMOS structure transmission gate 121, and furthermore, all other conditions are set so as to be identical.

With respect to the operation, when the CMOS structure transmission gate 121 is in an ON state, the charge cancel transistor 403 is in an OFF state, while when the CMOS structure transmission gate 121 is in an OFF state, the charge cancel transistor 403 is in an ON state. In other words, the ON and OFF states of the charge cancel transistor 403 and the CMOS structure transmission gate 121 are opposed to one another.

The charge cancel transistor 404 is a CMOS structure transmission gate in which the sources and drains of an NMOS and PMOS are connected to one another; this charge cancel transistor 404 is connected to an input electrode 117. With respect to this charge cancel transistor 404, the gate width of the PMOS and NMOS is set so as to be exactly half the gate width of the PMOS and NMOS of the CMOS structure transmission gate 122, and all other conditions are set so as to be identical.

With respect to the operation, when the CMOS structure transmission gate 122 is in an ON state, the charge cancel transistor 404 is in an OFF state, while when the CMOS structure transmission gate 122 is in an OFF state, the charge cancel transistor 404 is an ON state. In other words, the ON and OFF states of the charge cancel transistor 404 and the CMOS structure transmission gate 122 are opposed to one another.

The charge cancel transistor 405 is a CMOS structure transmission gate in which the sources and drains of an NMOS and PMOS are connected to one another; this charge cancel transistor 405 is connected to the input electrode 118. With respect to this charge cancel transistor 405, the gate widths of the PMOS and NMOS are set so as to be exactly half the gate widths of the PMOS and NMOS of the CMOS structure transmission gate 123, and all other conditions are set so as to be completely identical.

With respect to the operation, when the CMOS structure transmission gate 123 is in an ON state, the charge cancel transistor 405 is in an OFF state, and when the CMOS structure transmission gate 123 is in an OFF state, the charge cancel transistor is in an ON state. In other words, the ON and OFF states of the charge cancel transistor 405 and the CMOS structure transmission gate 123 are opposed to one another.

The charge cancel transistor 406 is a CMOS structure transmission gate in which the sources and drains of an NMOS and PMOS are connected to one another; this charge cancel transistor 406 is connected to input electrode 118. With respect to the charge cancel transistor 406, the gate widths of the PMOS and NMOS are set so as to be exactly half the gate widths of the PMOS and NMOS of the CMOS structure transmission gate 124, and all other conditions are set so as to be completely identical.

With respect to the operation, when the CMOS structure transmission gate 124 is in an ON state, the charge cancel transistor 406 is in an OFF state, while when the CMOS structure transmission gate 124 is in an OFF state, the charge cancel transistor 406 is in an ON state. In other words, the ON and OFF state of the charge cancel transistor 406 and the CMOS structure transmission gate 124 are opposed to one another.

The charge cancel transistor 407 is a CMOS structure transmission gate in which the sources and drains of an NMOS and PMOS are connected to one another; this charge cancel transistor 407 is connected to an input electrode 120. With respect to this charge cancel transistor 407, the gate widths of the PMOS and NMOS are set so as to be exactly half the gate widths of the PMOS and NMOS of the CMOS structure transmission gate 125, and furthermore, all other conditions are set so as to be completely identical.

With respect to the operation, when the CMOS structure transmission gate 125 is in an ON state, the charge cancel transistor 407 is in an OFF state, while when the CMOS structure transmission gate 125 is in an OFF state, the charge cancel transistor 407 is in an ON state. In other words, the ON and OFF states of the charge cancel transistor 407 and the CMOS structure transmission gate 125 are opposed to one another.

The charge cancel transistor 408 is a CMOS structure transmission gate in which the sources and drains of an NMOS and PMOS are connected to one another; this charge cancel transistor 408 is connected to an input electrode 120. With respect to this charge cancel transistor 408, the gate widths of the PMOS and NMOS are set so as to be exactly half the gate widths of the PMOS and NMOS of the CMOS structure transmission gate 126, and furthermore, all other conditions are set so as to be completely identical.

With respect to the operation, when the CMOS structure transmission gate 126 is in an ON state, the charge cancel transistor 408 is in an OFF state, while when the CMOS structure transmission gate 126 is in an OFF state, the charge cancel transistor 408 is in an ON state. In other words, the ON and OFF states of the charge cancel transistor 408 and CMOS structure transmission gate 126 are opposed to one another.

The charge cancel transistor 409 is a CMOS structure transmission gate in which the sources and drains of an NMOS and PMOS are connected to one another; this charge cancel transistor 409 is connected to an input electrode 119. With respect to this charge cancel transistor 409, the gate widths of the PMOS and NMOS are set so as to be exactly half the gate width of the PMOS and NMOS of the CMOS structure transmission gate 127, and the other conditions are set so as to be completely identical.

With respect to the operation, when the CMOS structure transmission gate 127 is in an ON state, the charge cancel transistor 409 is in an OFF state, and when the CMOS structure 127 is in an OFF state, the charge cancel transistor 409 is in an ON state. That is to say, the ON and OFF state of the charge cancel transistor 409 and the CMOS structure transmission gate 127 are opposed to one another.

The charge cancel transistor 410 is a CMOS structure transmission gate in which the sources and drains of an NMOS and PMOS are connected to one another; this charge cancel transistor 410 is connected to an input electrode 119. With respect to this charge cancel transistor 410, the gate width of the PMOS and NMOS is set so as to be exactly half the gate width of the PMOS and NMOS of the CMOS structure transmission gate 128, and furthermore, the other conditions are set so as to be completely identical.

With respect to the operation, when the CMOS structure transmission gate 128 is in an ON state, the charge cancel transistor 410 is in an OFF state, and when the CMOS structure transmission gate 128 is in an OFF state, the charge cancel transistor 410 is an ON state. In other words, the ON and OFF states of the charge cancel transistor 410 and CMOS structure transmission gate 128 are opposed to one another.

The charge cancel transistors 401, 402, 403, 404, 405, 406, 407, 408, 409, and 410 are connected as shown in FIG. 4 so that no problems will be caused when the switching elements 113, 115, 121, 122, 123, 124, 125, 126, 127, and 128 are realized using PMOS, NMOS, or the like. When transistors are used as the switches, the voltage signal applied to the gate electrode of the transistors is what determines the ON and OFF state thereof. By changing this voltage signal from 0V to 5V, it is possible to determine whether the transistor is in an ON state or an OFF state.

The problem is that when the signal applied to this gate electrode is switched, for example, to consider this in terms of the NMOS, when the change is from 5V to 0V and the transistor changes from an ON state to an OFF state, a portion of the charge stored in the channel of the NMOS transistor undesirably flows to both electrodes connected to switches, and the potential in the output side fluctuates slightly. When the potential on the output side fluctuates, this leads to mistakes in the arithmetic results, and there is a danger that accurate calculations become impossible. Here, what is meant by the output side potential is gate electrodes 103 and 104 and input electrodes 117, 118, 119, and 120.

As a method of solving this problem, almost no problems will be presented if, with respect to the clock voltage applied to the switching elements within the circuitry, the time period during which the clock voltage changes from 5V to 0V is lengthened; however, when attempts are made to increase the operational speed of the circuit as a whole, this is impossible if the time period during which the clock signal changes is not made short. As the period of change is shortened, the effect of the charge appearing on the output side from the channel to transistors becomes progressively larger. Accordingly, it is impossible to increase the speed above a certain level. This problem is termed clock feedthrough; with respect to this problem, it is said that the amount of charge presently appearing in the output side is exactly half of the charge stored in the channel of the switch transistors.

Accordingly, if, here, transistors in which the source and drain are connected only having half the gate width size are grounded on the output side, and have ON and OFF state timings which are the opposite of those of the switch transistors, then the charge which appears on the output side when the switch transistor enters an OFF state can be absorbed in the process of entering an ON state by the charge cancel transistor, and furthermore, the charge appearing during the process of entering an OFF state from the channel of the charge cancel transistor when the switch transistor enters an ON state can be absorbed by the channel of the switch transistor, so that this clock feedthrough problem can be solved.

Accordingly, it is possible to conduct more highly accurate analog calculations. Here, the gate width of the charge cancel transistors was set at half the gate width of the corresponding switch element transistors; however, the amount of charge which appears in the output side during the period of voltage change of the clock voltage changes slightly from the amount of charge which is presently said to commonly appear, so that it is not necessarily the case that the gate width must be half, and this may change from case to case. Accordingly, the gate width of the charge cancel transistor is not necessarily limited to half; it may have a size in correspondence with the switching elements.

(Embodiment 4)

Figure 5:
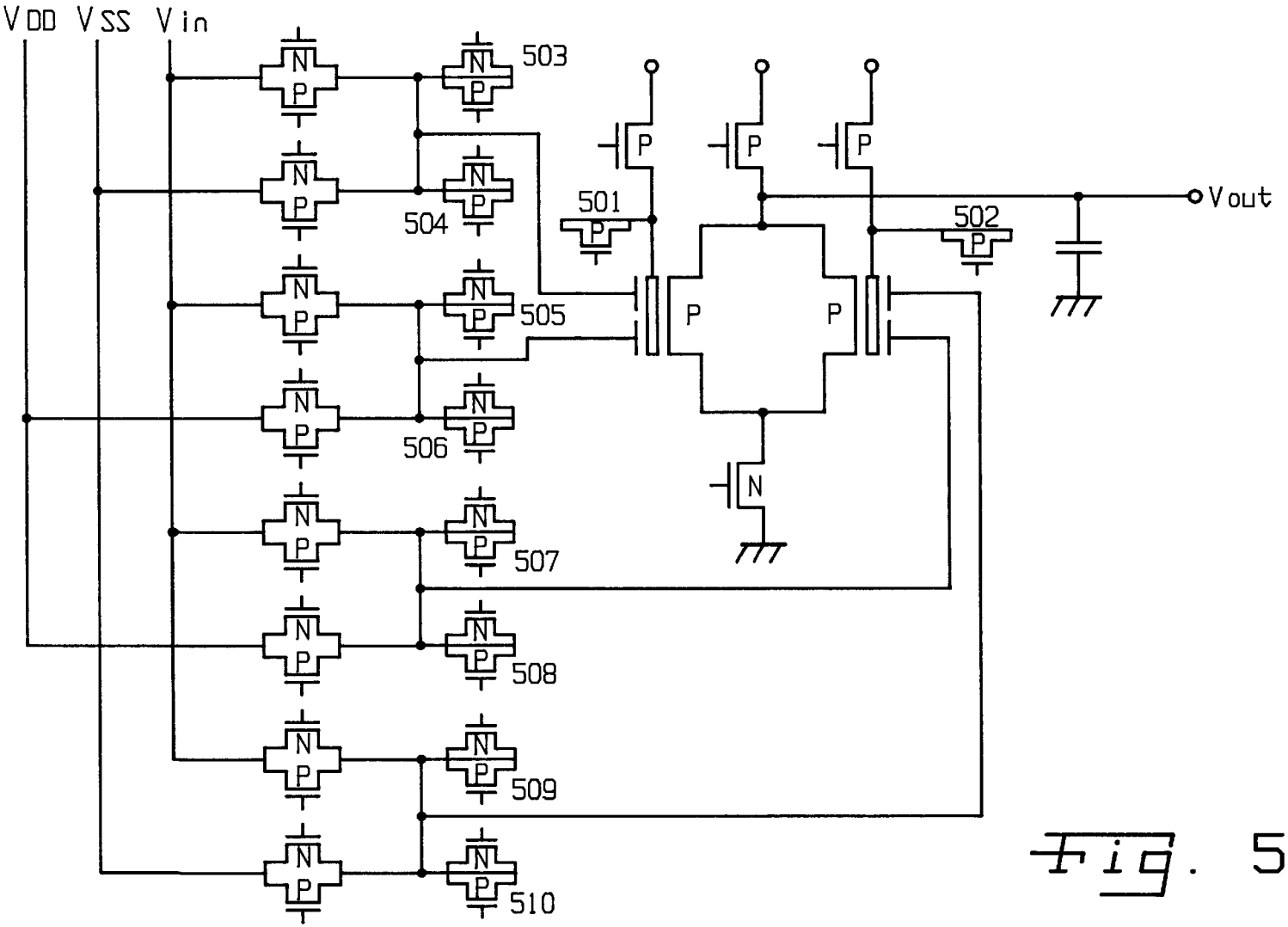
FIG. 5 is a circuit diagram relating to a fourth embodiment.

FIG. 5 shows a fourth embodiment of the present invention. This embodiment has a structure which is almost identical to that of the second embodiment. Accordingly, only that structure which has changed and the operational principle will be explained.

Charge cancel transistor 501 is, here, a PMOS transistor, and the source and drain thereof are directly connected to one another. Additionally, the charge cancel transistor 501 is connected to the gate electrode of PMOS transistor 301. The gate width of this charge cancel transistor 501 is set so as to be half of the gate width of the PMOS transistor 313, for example, and the other conditions are set so as to be identical.

With respect to the operation, when the PMOS transistor 313 is an ON state, the charge cancel transistor 501 is an OFF state, and when the PMOS transistor 313 is in an OFF state, the charge cancel transistor 501 is in an ON state. In other words, the ON and OFF states are opposite to one another.

Charge cancel transistor 502 is, here, a PMOS transistor, and the source and drain thereof are directly connected to one another. Additionally, the charge cancel transistor 502 is connected to the gate electrode of PMOS transistor 302. The gate width of this charge cancel transistor 502 is set so as to be half of the gate width of the PMOS transistor 315, for example, and the other conditions are set so as to be identical.

With respect to the operation, when the PMOS transistor 315 is an ON state, the charge cancel transistor 502 is an OFF state, and when the PMOS transistor 315 is in an OFF state, the charge cancel transistor 502 is in an ON state. In other words, the ON and OFF states are opposite to one another.

Charge cancel transistor 503 is a CMOS structure transmission gate in which the sources and drains of an NMOS and PMOS are connected to one another; this charge cancel transistor 503 is connected to an input electrode 317. With respect to this charge cancel transistor 503, the gate width of the PMOS and NMOS is set so as to be exactly half the gate width of the PMOS and NMOS of the CMOS structure transmission gate 321, and the other conditions are set so as to be identical.

With respect to the operation, when the CMOS structure transmission gate 321 is in an ON state, the charge cancel transistor 503 is in an OFF state, and when the CMOS structure transmission gate 321 is in an OFF state, the charge cancel transistor 503 is in an ON state. In other words, the structure is such that the ON and OFF states of the charge cancel transistor 503 and the CMOS structure transmission gate 321 are opposite to one another.

Charge cancel transistor 504 is a CMOS structure transmission gate in which the sources and drains of an NMOS and PMOS are connected to one another; this charge cancel transistor 504 is connected to an input electrode 317. With respect to this charge cancel transistor 504, the gate width of the PMOS and NMOS is set so as to be exactly half the gate width of the PMOS and NMOS of the CMOS structure transmission gate 322, and the other conditions are set so as to be identical.

With respect to the operation, when the CMOS structure transmission gate 322 is in an ON state, the charge cancel transistor 504 is in an OFF state, and when the CMOS structure transmission gate 322 is in an OFF state, the charge cancel transistor 504 is in an ON state. In other words, the structure is such that the ON and OFF states of the charge cancel transistor 504 and the CMOS structure transmission gate 322 are opposite to one another.

Charge cancel transistor 505 is a CMOS structure transmission gate in which the sources and drains of an NMOS and PMOS are connected to one another; this charge cancel transistor 505 is connected to an input electrode 318. With respect to this charge cancel transistor 505, the gate width of the PMOS and NMOS is set so as to be exactly half the gate width of the PMOS and NMOS of the CMOS structure transmission gate 323, and the other conditions are set so as to be identical.

With respect to the operation, when the CMOS structure transmission gate 323 is in an ON state, the charge cancel transistor 505 is in an OFF state, and when the CMOS structure transmission gate 323 is in an OFF state, the charge cancel transistor 505 is in an ON state. In other words, the structure is such that the ON and OFF states of the charge cancel transistor 505 and the CMOS structure transmission gate 323 are opposite to one another.

Charge cancel transistor 506 is a CMOS structure transmission gate in which the sources and drains of an NMOS and PMOS are connected to one another; this charge cancel transistor 506 is connected to an input electrode 318. With respect to this charge cancel transistor 506, the gate width of the PMOS and NMOS is set so as to be exactly half the gate width of the PMOS and NMOS of the CMOS structure transmission gate 324, and the other conditions are set so as to be identical.

With respect to the operation, when the CMOS structure transmission gate 324 is in an ON state, the charge cancel transistor 506 is in an OFF state, and when the CMOS structure transmission gate 324 is in an OFF state, the charge cancel transistor 506 is in an ON state. In other words, the structure is such that the ON and OFF states of the charge cancel transistor 506 and the CMOS structure transmission gate 324 are opposite to one another.

Charge cancel transistor 507 is a CMOS structure transmission gate in which the sources and drains of an NMOS and PMOS are connected to one another; this charge cancel transistor 507 is connected to an input electrode 320. With respect to this charge cancel transistor 507, the gate width of the PMOS and NMOS is set so as to be exactly half the gate width of the PMOS and NMOS of the CMOS structure transmission gate 325, and the other conditions are set so as to be identical.

With respect to the operation, when the CMOS structure transmission gate 325 is in an ON state, the charge cancel transistor 507 is in an OFF state, and when the CMOS structure transmission gate 325 is in an OFF state, the charge cancel transistor 507 is in an ON state. In other words, the structure is such that the ON and OFF states of the charge cancel transistor 507 and the CMOS structure transmission gate 325 are opposite to one another.

Charge cancel transistor 508 is a CMOS structure transmission gate in which the sources and drains of an NMOS and PMOS are connected to one another; this charge cancel transistor 508 is connected to an input electrode 320. With respect to this charge cancel transistor 508, the gate width of the PMOS and NMOS is set so as to be exactly half the gate width of the PMOS and NMOS of the CMOS structure transmission gate 326, and the other conditions are set so as to be identical.

With respect to the operation, when the CMOS structure transmission gate 326 is in an ON state, the charge cancel transistor 508 is in an OFF state, and when the CMOS structure transmission gate 326 is in an OFF state, the charge cancel transistor 508 is in an ON state. In other words, the structure is such that the ON and OFF states of the charge cancel transistor 508 and the CMOS structure transmission gate 326 are opposite to one another.

Charge cancel transistor 509 is a CMOS structure transmission gate in which the sources and drains of an NMOS and PMOS are connected to one another; this charge cancel transistor 509 is connected to an input electrode 319. With respect to this charge cancel transistor 509, the gate width of the PMOS and NMOS is set so as to be exactly half the gate width of the PMOS and NMOS of the CMOS structure transmission gate 327, and the other conditions are set so as to be identical.

With respect to the operation, when the CMOS structure transmission gate 327 is in an ON state, the charge cancel transistor 509 is in an OFF state, and when the CMOS structure transmission gate 327 is in an OFF state, the charge cancel transistor 509 is in an ON state. In other words, the structure is such that the ON and OFF states of the charge cancel transistor 509 and the CMOS structure transmission gate 327 are opposite to one another.

Charge cancel transistor 510 is a CMOS structure transmission gate in which the sources and drains of an NMOS and PMOS are connected to one another; this charge cancel transistor 510 is connected to an input electrode 319. With respect to this charge cancel transistor 503, the gate width of the PMOS and NMOS is set so as to be exactly half the gate width of the PMOS and NMOS of the CMOS structure transmission gate 328, and the other conditions are set so as to be identical.

With respect to the operation, when the CMOS structure transmission gate 328 is in an ON state, the charge cancel transistor 510 is in an OFF state, and when the CMOS structure transmission gate 328 is in an OFF state, the charge cancel transistor 510 is in an ON state. In other words, the structure is such that the ON and OFF states of the charge cancel transistor 510 and the CMOS structure transmission gate 328 are opposite to one another.

The charge cancel transistors 501, 502, 503, 504, 505, 506, 507, 508, 509, and 510 are connected as shown in FIG. 5 so that no problems will be caused when the switching elements 313, 315, 321, 322, 323, 324, 325, 326, 327, and 328 are realized using PMOS, NMOS, or the like. When transistors are used as the switches, the voltage signal applied to the gate electrode of the transistors is what determines the ON and OFF state thereof. By changing this voltage signal from 0V to 5V, it is possible to determine whether the transistor is in an ON state or an OFF state.

The problem is that when the signal applied to this gate electrode is switched, for example, to consider this in terms of the NMOS, when the change is from 5V to 0V and the transistor changes from an ON state to an OFF state, a portion of the charge stored in the channel of the NMOS transistor undesirably flows to both electrodes connected to switches, and the potential in the output side fluctuates slightly. When the potential on the output side fluctuates, this leads to mistakes in the arithmetic results, and there is a danger that accurate calculations become impossible. Here, what is meant by the output side potential is gate electrodes 303 and 304 and input electrodes 317, 318, 319, and 320.

As a method of solving this problem, almost no problems will be presented if, with respect to the clock voltage applied to the switching elements within the circuitry, the time period during which the clock voltage changes from 5V to 0V is lengthened; however, when attempts are made to increase the operational speed of the circuit as a whole, this is impossible if the time period during which the clock signal changes is not made short. As the period of change is shortened, the effect of the charge appearing on the output side from the channel to transistors becomes progressively larger. Accordingly, it is impossible to increase the speed above a certain level. This problem is termed clock feedthrough; with respect to this problem, it is said that the amount of charge presently appearing in the output side is exactly half of the charge stored in the channel of the switch transistors.

Accordingly, if, here, transistors in which the source and drain are connected only having half the gate width size are grounded on the output side, and have ON and OFF state timings which are the opposite of those of the switch transistors, then the charge which appears on the output side when the switch transistor enters an OFF state can be absorbed in the process of entering an ON state by the charge cancel transistor, and furthermore, the charge appearing during the process of entering an OFF state from the channel of the charge cancel transistor when the switch transistor enters an ON state can be absorbed by the channel of the switch transistor, so that this clock feedthrough problem can be solved.

Accordingly, it is possible to conduct more highly accurate analog calculations. Here, the gate width of the charge cancel transistors was set at half the gate width of the corresponding switch element transistors; however, the amount of charge which appears in the output side during the period of voltage change of the clock voltage changes slightly from the amount of charge which is presently said to commonly appear, so that it is not necessarily the case that the gate width must be half, and this may change from case to case. Accordingly, the gate width of the charge cancel transistor is not necessarily limited to half; it may have a size in correspondence with the switching elements.

(Embodiment 5)

Figure 6:
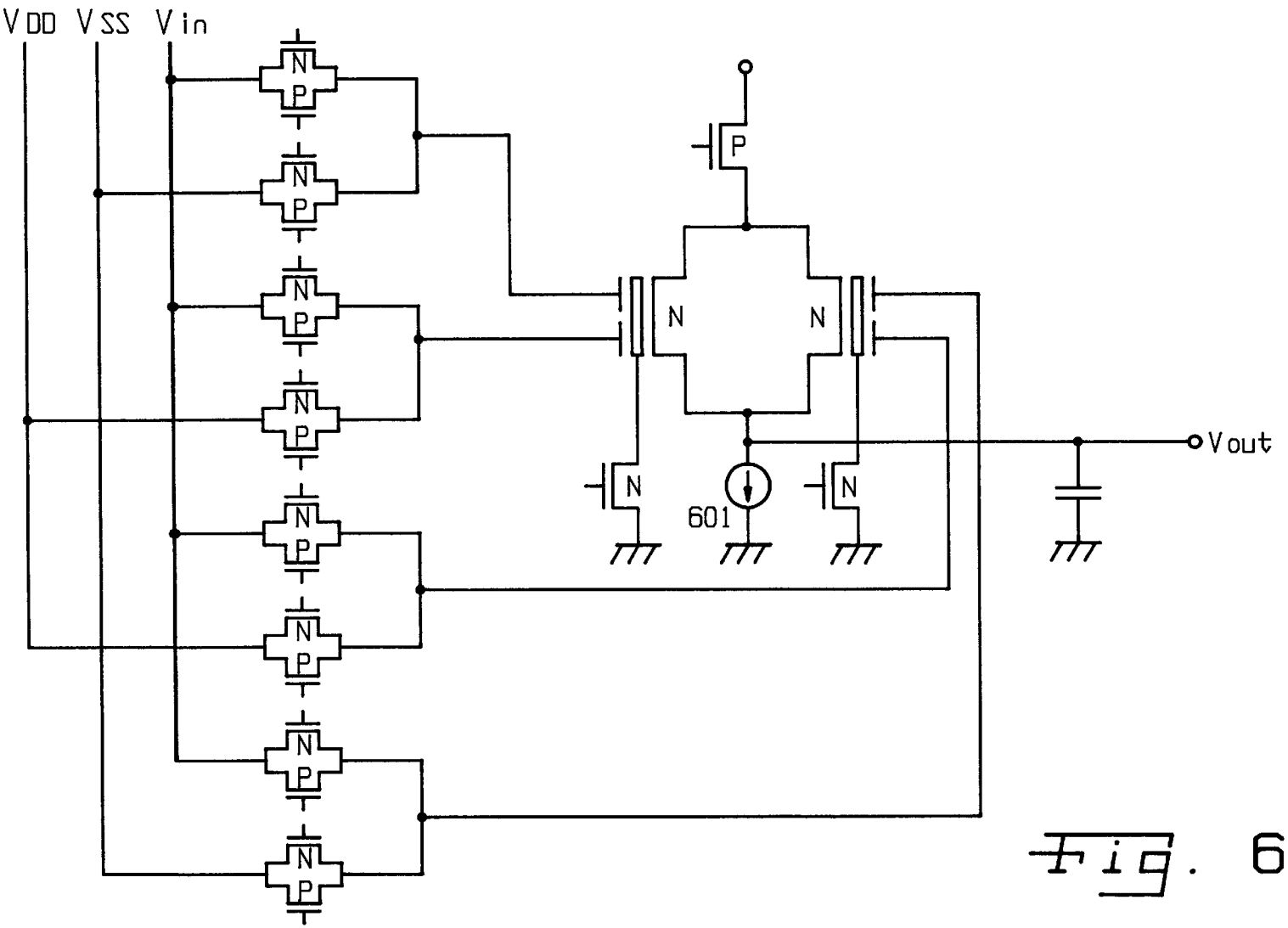
FIG. 6 is a circuit diagram relating to a fifth embodiment.

FIG. 6 is a circuit diagram showing the fifth embodiment. This embodiment has a structure which is almost identical to that of the first embodiment. In the first embodiment, the sources 109 and 110 of NMOS transistors 101 and 102 were connected to one another and were connected with a ground potential 112 via a switching element; however, here, in place of a switching element, these are connected to the ground potential 112 via a current source 601. The basic operation is identical to that in the case of embodiment 1, so that only those parts of the structure and the operational principle which have changed will be explained.

Here, the sources 109 and 110 of NMOS transistors 101 and 102 are connected to one another, and these are connected to a ground potential 112 via a current source 601. With respect to the operation, operation is conducted in the manner of embodiment 1, and the potentials of gate electrode 103 and 104 reach values representing the difference from the inputted voltage. After this, switching element 107 is placed in an ON state, and the larger of the potential of gate electrodes 103 and 104 decreases by the amount of the effective voltage of the current flowing as a result of current source 601 and is outputted as Vout.

When current source 601 is not provided and operations are conducted using a switching element 111 such as that in embodiment 1, the output terminal is in a floating state during output operations, and furthermore, by conducting source follower operations, the operational result is outputted, so that this causes a problem in that the operation speed is low. Here, by using current source 601 in place of the switching element, a standard amount of current constantly flows, so that it is possible to obtain an extremely high response speed.

By constantly causing a current to flow, there is also the possibility of causing power consumption problems; however, if the current which is caused to flow is made extremely small at the design stage, no such problems occur.

Furthermore, here, a circuit structure was proposed in which no charge cancel transistors were provided at the switching elements used in the switching of the input signals; however, in order to conduct more accurate operations, it is of course the case that the circuit structure may be provided with charge cancel transistors.

By means of this, the problem of the slow response time when the output terminal is placed in a floating state is solved, and it is possible to realize highly accurate analog operations.

(Embodiment 6)

Figure 7:
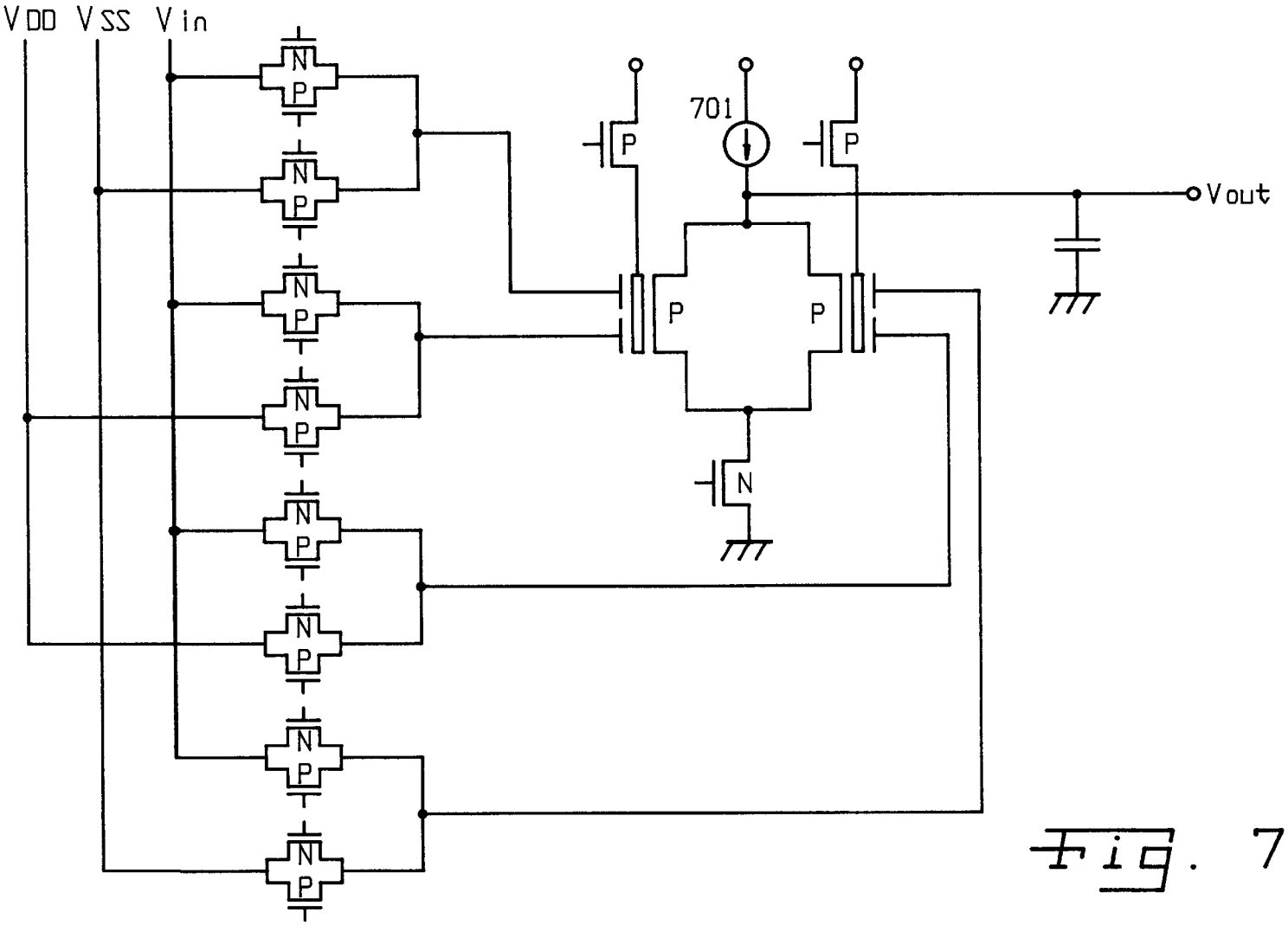
FIG. 7 is a circuit diagram relating to a sixth embodiment.

FIG. 7 is circuit diagram showing a sixth embodiment.

This embodiment has a structure which is almost identical to that of the second embodiment. In the second embodiment, the sources 309 and 310 of the PMOS transistors 301 and 302 are connected to one another, and these are connected to a power source potential 312 using a PMOS as a switching element; however, here, in place of the switching element, connection to the power source potential 312 is via a current source 701. The basic operation is the same as in the case of embodiment 1, so that only those parts of the structure and operational principle which have changed will be explained.

Here, the sources 309 and 310 of the PMOS transistors 301 and 302 are connected to one another, and these are connected to a power source potential 112 via a current source 701.

With respect to the operation, the operation is the same as in embodiment 3; the potential of gate electrodes 303 and 304 represents the value of the difference between the input voltages subtracted from the power source potential ($V_{DD}$). Then, the switching element 307 is placed in an ON state, and the smaller of the potentials of gate electrodes 303 and 304 is increased by the effective voltage of the amount of current caused to flow by current source 701, and this is outputted as Vout.

When current source 701 is not provided, and operations are conducted using a switching element such as that in embodiment 3, the output terminal is a floating state during the output operation, and furthermore, by conducting source follower operations, the arithmetical result is outputted, so that there is a problem in that the operational speed is low. Here, by using current source 701 in place of the switching element, a standard current constantly flows, and it is possible to obtain an extremely high response speed.

By causing a constant current flow, there is a possibility that power consumption will become a problem; however, if the current which is caused to flow is made extremely small at the design stage, this will not become a problem.

Furthermore, the circuit structure was employed in which the switching elements which were used in the switching of the input signals were not provided with charge cancel transistors; however, it is of course the case that a circuit structure may be provided in which charge cancel transistors are provided in order to conduct more highly accurate operations.

By means of this, the slow response speed which presented a problem when the output terminal was placed in a floating state is solved, and it is possible to realize highly accurate analog operations.

(Embodiment 7)

Figure 8:
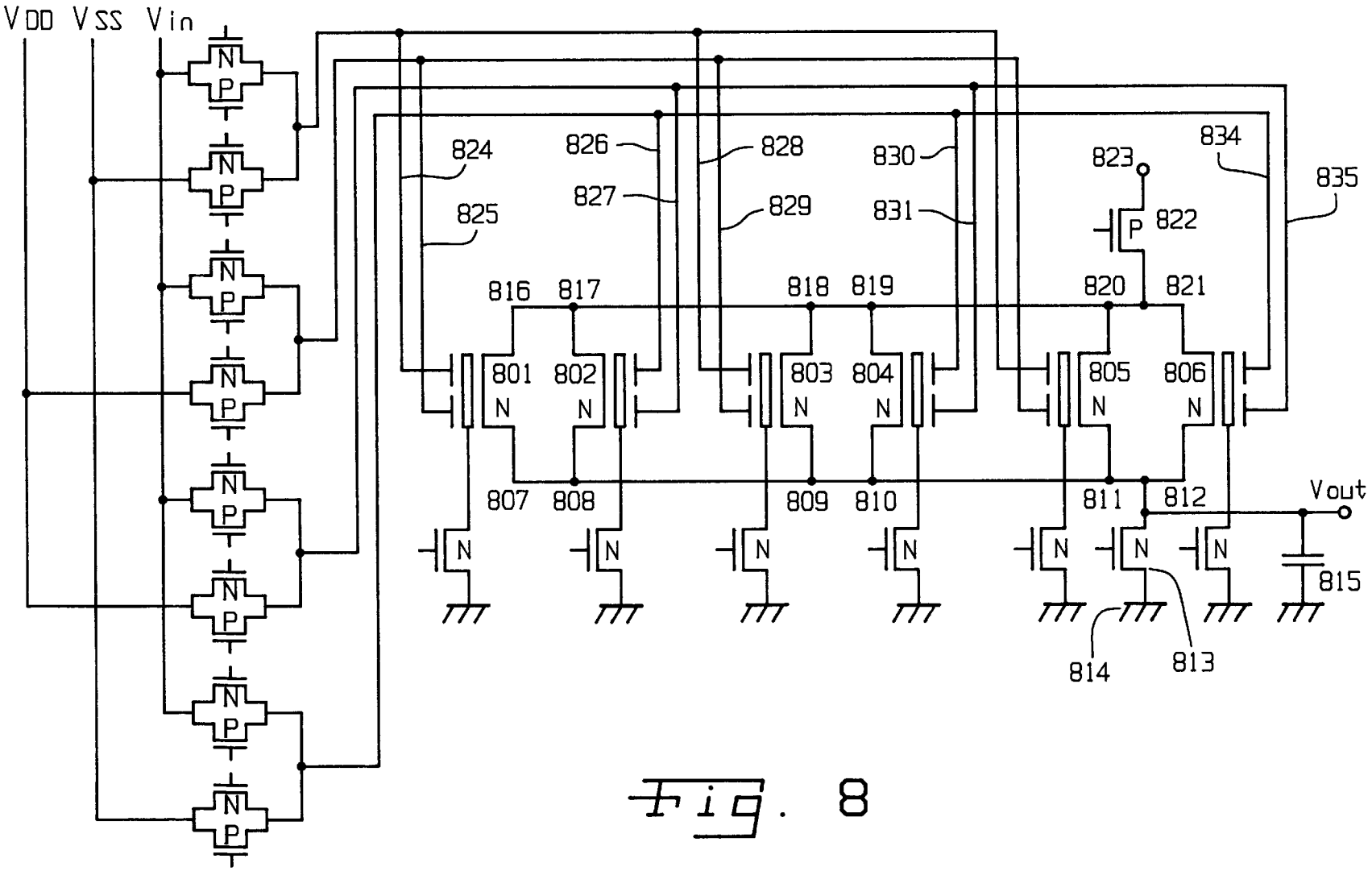
FIG. 8 is a circuit diagram relating to a seventh embodiment.

FIG. 8 is a circuit diagram showing a seventh embodiment. In this embodiment, a plurality of the circuits described in embodiment 1 (ROM type difference absolute value circuits) are arranged, and the source electrodes of the respective NMOS transistors are connected to one another. Here, the circuit has only one type of inputted data; there are three types of capacitive coupling ratios among the terminals capacitively coupled to the gate electrodes of the respective NMOS transistors. The reason for this is that, as is clear from embodiment 1, when the number of inputted data is 2, 2 NMOS transistors are necessary to find the difference. Accordingly, when the number of inputted data is 3 or more, two of these data must be selected at a time from among these 3, and the absolute value of the difference must be obtained with respect to each, so that, from the calculation ${}_3C_2=6$, realization can be conducted using three groups of ROM type difference absolute value circuits.

In this circuitry, the source electrodes 807, 808, 809, 810, 811, and 812 of the NMOS transistors 801, 802, 803, 804, 805, and 806 are connected to one another, and these are connected to the ground potential 814 via NMOS transistor 813 as a switching element. Furthermore, the drain electrodes 816, 817, 818, 819, 820, and 821 of the NMOS transistors 801, 802, 803, 804, 805, and 806 are connected to one another, and these are connected to a power source potential 823 via PMOS transistor 822 as a switching element. By connecting source electrodes 807, 808, 809, 810, 811, and 812 to, for example, an external capacity load 815, it becomes possible to read out the arithmetic results of the circuit as an output. Furthermore, in this circuitry, input terminals 824, 825, 826, 827 are capacitively coupled to NMOS transistors 801 and 802 by, respectively, capacities $C_1$, $C_2$, $C_3$, and $C_4$, and the capacitive coupling ratio is $C_1/C_2=C_3/C_4$, while input terminals 828, 829, 830, and 831 are capacitively coupled to the gate electrodes of the NMOS transistors 803 and 804 by, respectively, capacities $C_5$, $C_6$, $C_7$, and $C_8$, and the capacitive coupling ratios are $C_5/C_6=C_7/C_8$, and the input terminals 832, 833, 834, and 835 are capacitively coupled to the gate electrodes of NMOS transistors 805 and 806 by capacities $C_9$, $C_{10}$, $C_{11}$, and $C_{12}$, and the capacitive coupling ratios are $C_9/C_{10}=C_{11}/C_{12}$.

With respect to the operation of the circuit, if, here, the analog voltage expressed by the capacitive coupling ratio in the NMOS 801 and 802 group is represented by $V_{mx}$, the analog voltage expressed by the capacitive coupling ratio in the NMOS 803 and 804 group is represented by $V_{my}$, and the analog voltage represented by the capacitive coupling ratio in the NMOS 805 and 806 group is represented by $V_{mz}$, then the combination of input voltages in the circuit is (Vin, $V_{mx}$), (Vin, $V_{my}$), (Vin, $V_{mz}$). The concrete operating principle of the circuit with respect to these various groups is identical to the operating principle described in the first embodiment, so that an explanation thereof will be omitted here. In this embodiment, the largest value among the operational results $|Vin-V_{mx}|$ $|Vin-V_{my}|$ and $|Vin-V_{mz}|$ among the groups of the circuit is outputted.

Furthermore, with respect to the necessary number of circuits, only that number of groups is necessary which is represented by the formula ${}_NC_2/2$, where the number of inputted data is represented by N and the circuitry described in embodiment 1 comprises one group.

By means of this, it is possible to handle a number of data greater than 2, and it is possible to rapidly and highly accurately select the two data which are most similar from a large number of data.

Here, an example was described in which one type of data was inputted from the exterior and three types of analog voltages were determined by the capacitive coupling ratios of the input terminals capacitively coupled to the gate electrodes of the NMOS transistors; however, it is of course the case that no problems will be caused if one type of analog voltage is determined by the capacitive coupling ratio of the input terminals and three types of data are inputted from the exterior.

Furthermore, here, the ROM type difference absolute value circuitry described in embodiment 1 was used as the circuit of the individual groups; however, it is of course the case that the circuitry described in embodiment 3 or embodiment 5 may also be employed.

(Embodiment 8)

Figure 9:
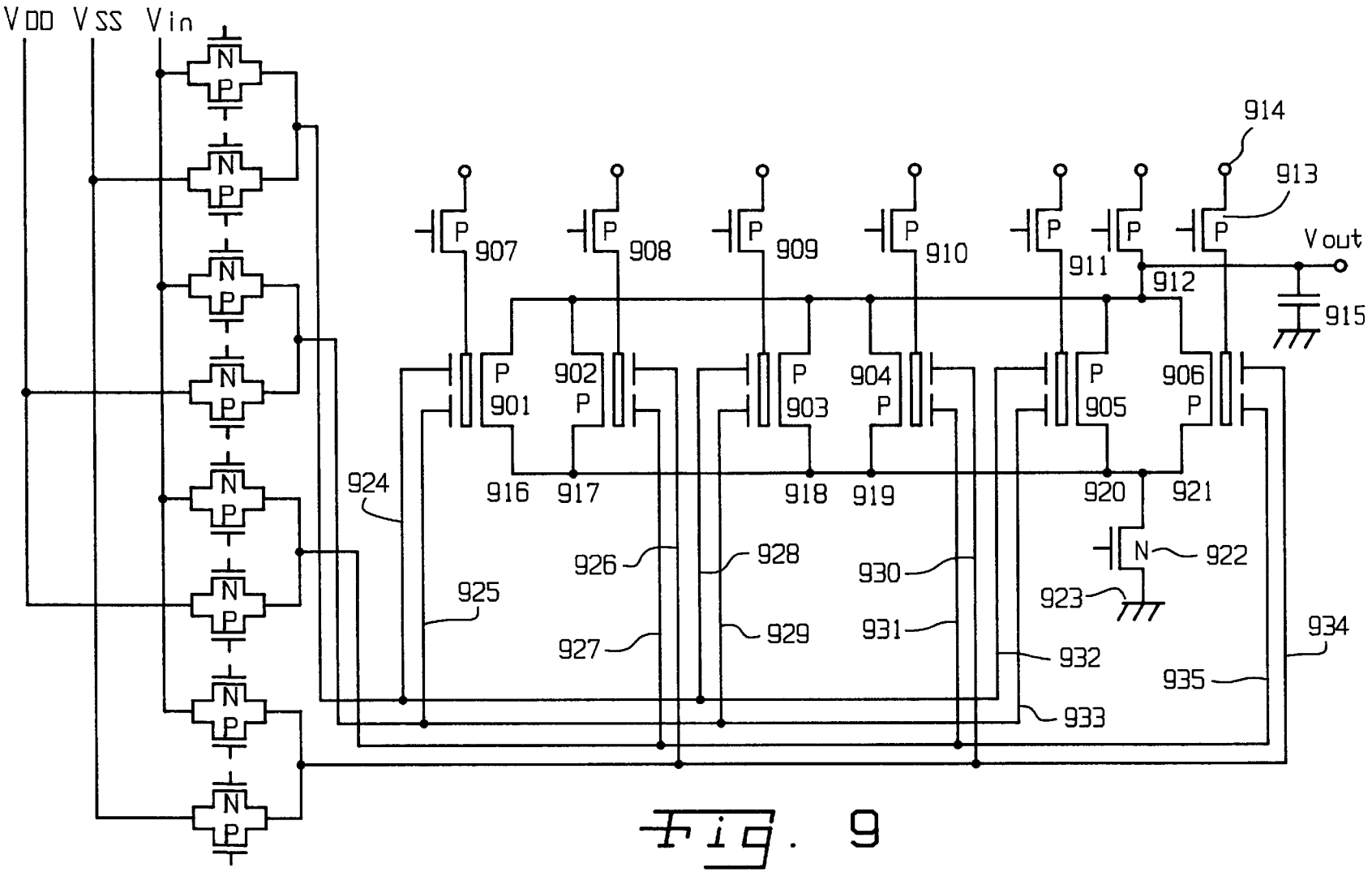
FIG. 9 is a circuit diagram relating to an eighth embodiment.

FIG. 9 is a circuit diagram showing an eighth embodiment. In this embodiment, a plurality of the circuits described in embodiment 2 (ROM type difference absolute value circuits) are arranged, and the source electrodes of the respective PMOS transistors are connected to one another. Here, the circuit has only one type of inputted data; there are three types of capacitive coupling ratios among the terminals capacitively coupled to the gate electrodes of the respective PMOS transistors. The reason for this is that, as is clear from embodiment 2, when the number of inputted data is 2, 2 PMOS transistors are necessary to find the difference. Accordingly, when the number of inputted data is 3 or more, two of these data must be selected at a time from among these 3, and the absolute value of the difference must be obtained with respect to each, so that, from the calculation ${}_3C_2=6$, realization can be conducted using three groups of ROM type difference absolute value circuits.

In this circuitry, the source electrodes 907, 908, 909, 910, 911, and 912 of the PMOS transistors 901, 902, 903, 904, 905, and 906 are connected to one another, and these are connected to the ground potential 914 via a PMOS transistor 913 as a switching element. Furthermore, the drain electrodes 916, 917, 918, 919, 920, and 921 of the PMOS transistors 901, 902, 903, 904, 905, and 906 are connected to one another, and these are connected to a power source potential 923 via NMOS transistor 922 as a switching element. By connecting source electrodes 907, 908, 909, 910, 911, and 912 to, for example, an external capacity load 915, it becomes possible to read out the arithmetic results of the circuit as an output. Furthermore, in this circuitry, input terminals 924, 925, 926, 927 are capacitively coupled to PMOS transistors 901 and 902 by, respectively, capacities $C_1$, $C_2$, $C_3$, and $C_4$, and the capacitive coupling ratio is $C_1/C_2=C_3/C_4$, while input terminals 928, 929, 930, and 931 are capacitively coupled to the gate electrodes of the PMOS transistors 903 and 904 by, respectively, capacities $C_5$, $C_6$, $C_7$, and $C_8$, and the capacitive coupling ratios are $C_5/C_6=C_7/C_8$, and the input terminals 932, 933, 934, and 935 are capacitively coupled to the gate electrodes of PMOS transistors 905 and 906 by capacities $C_9$, $C_{10}$, $C_{11}$, and $C_{12}$, and the capacitive coupling ratios are $C_9/C_{10}=C_{11}/C_{12}$.

With respect to the operation of the circuit, if, here, the analog voltage expressed by the capacitive coupling ratio in the PMOS 901 and 902 group is represented by $V_{mx}$, the analog voltage expressed by the capacitive coupling ratio in the PMOS 903 and 904 group is represented by $V_{my}$, and the analog voltage represented by the capacitive coupling ratio in the PMOS 905 and 906 group is represented by $V_{mz}$, then the combination of input voltages in the circuit is (Vin, $V_{mx}$), (Vin, $V_{my}$), (Vin, $V_{mz}$). The concrete operating principle of the circuit with respect to these various groups is identical to the operating principle described in the second embodiment, so that an explanation thereof will be omitted here. In this embodiment, the smallest value among the operational results $|V_{DD}+(Vin-V_{mx})|$ $|V_{DD}+(Vin-V_{my})|$ and $|V_{DD}+(Vin-V_{mz})|$ among the groups of the circuit is outputted.

Furthermore, with respect to the necessary number of circuits, only that number of groups is necessary which is represented by the formula ${}_NC_2/2$, where the number of inputted data is represented by N and the circuitry described in embodiment 1 comprises one group.

By means of this, it is possible to handle a number of data greater than 2, and it is possible to rapidly and highly accurately select the two data which are most similar from a large number of data.

Here, an example was described in which one type of data was inputted from the exterior and three types of analog voltages were determined by the capacitive coupling ratios of the input terminals capacitively coupled to the gate electrodes of the PMOS transistors; however, it is of course the case that no problems will be caused if one type of analog voltage is determined by the capacitive coupling ratio of the input terminals and three types of data are inputted from the exterior.

Furthermore, here, the ROM type difference absolute value circuitry described in embodiment 1 was used as the circuit of the individual groups; however, it is of course the case that the circuitry described in embodiment 4 or embodiment 6 may also be employed.

(Embodiment 9)

Figure 10:
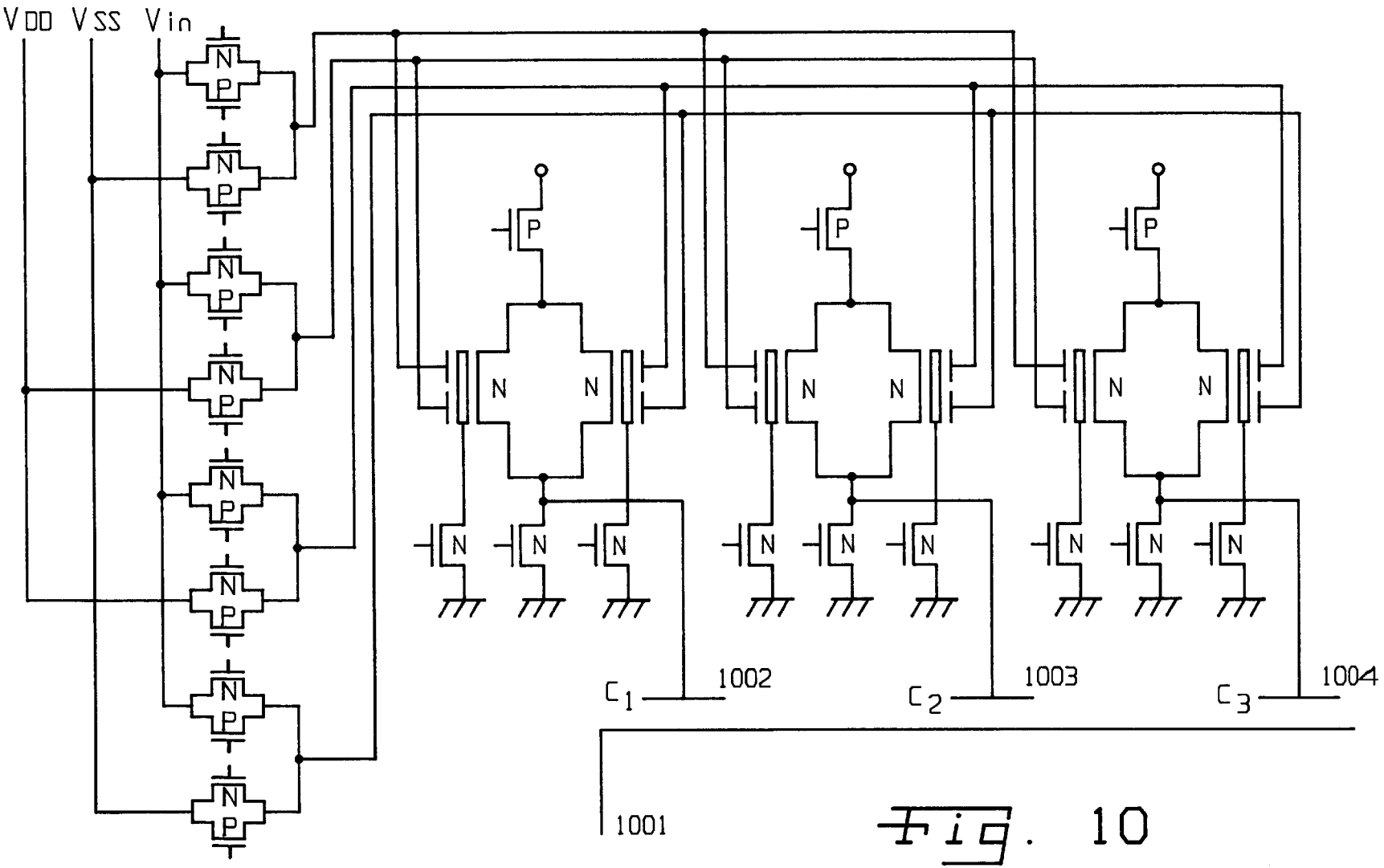
FIG. 10 is a circuit diagram relating to a ninth embodiment.

FIG. 10 is a circuit diagram showing the ninth embodiment. In this embodiment, a plurality of the circuits described in embodiment 1 are arranged, and the outputs thereof are capacitively coupled to an electrode 1001. By means of this, it is possible to average the results of the operations in the respective circuits.

The circuit structure in this embodiment will now be described. A plurality of the circuits described in embodiment 1 (ROM type absolute value circuits) are arranged. The output electrodes 1002, 1003, and 1004 of the respective difference absolute value circuits are capacitively coupled to electrode 1001 by capacities $C_1$, $C_2$, and $C_3$. These capacities $C_1$, $C_2$, and $C_3$ are all equal here.

By means of this, an operation is conducted to determine to what extent the respective two data resemble one another, and it is possible to average the results of these operations, so that it is possible to rapidly and highly accurately compress data expressed in an analog format.

Here, the ROM type difference absolute value circuits described in embodiment 1 were employed in the combination of individual circuits; however, it is of course the case that no problems will be caused if the circuitry described in embodiment 3, embodiment 5, or embodiment 7 is employed, depending on the purpose.

(Embodiment 10)

Figure 11:
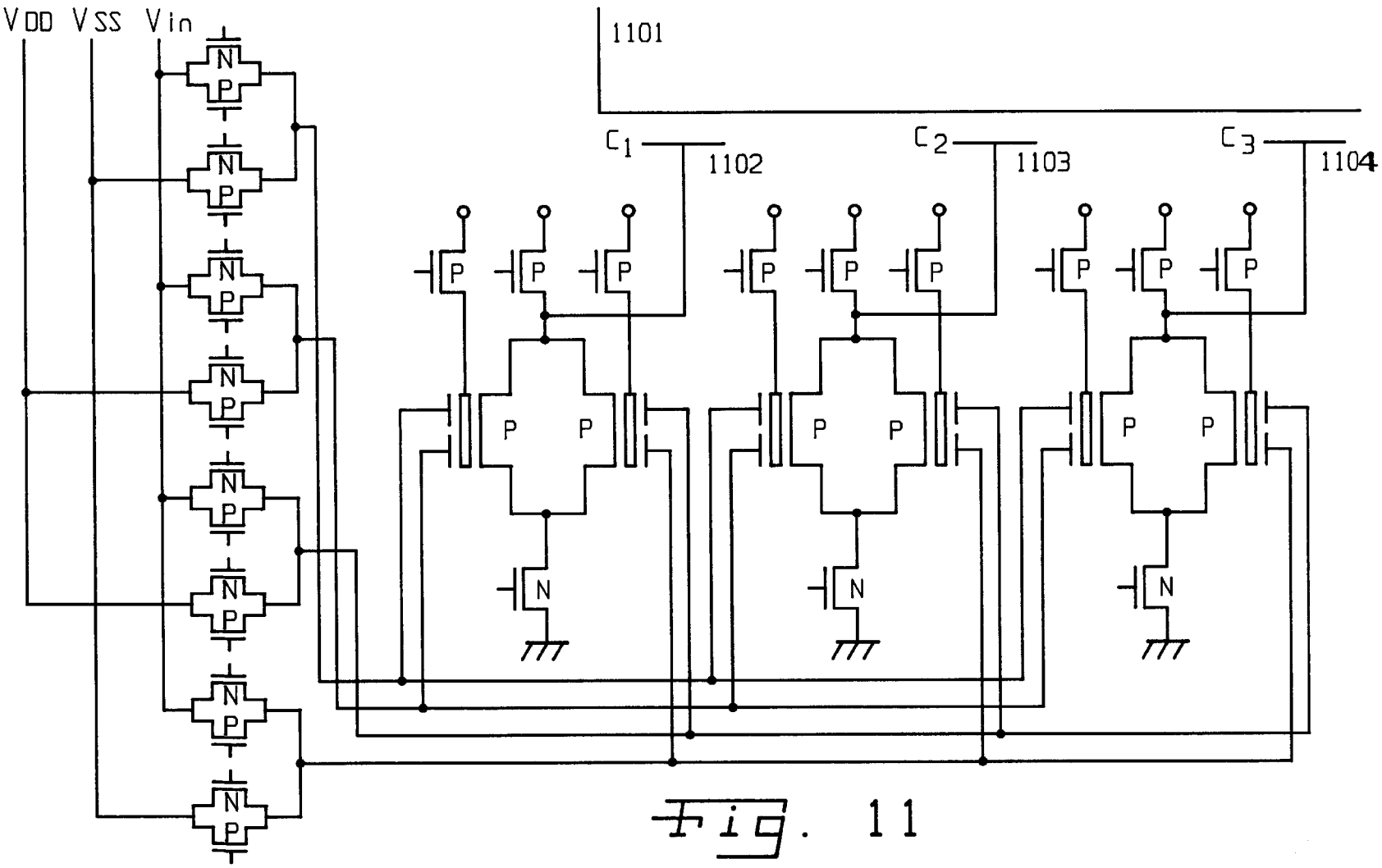
FIG. 11 is a circuit diagram relating to a tenth embodiment.

FIG. 11 is a circuit diagram showing a tenth embodiment. In this embodiment, a plurality of the circuits described in embodiment 1 are arranged, and the outputs thereof are capacitively coupled to an electrode 1101. By means of this, it is possible to average the results of the operations in the respective circuits.

The circuit structure in this embodiment will now be described. A plurality of the circuits described in embodiment 2 (ROM type absolute value circuits) are arranged. The output electrodes 1102, 1103, and 1104 of the respective difference absolute value circuits are capacitively coupled to electrode 1101 by capacities $C_1$, $C_2$, and $C_3$. These capacities $C_1$, $C_2$, and $C_3$ are all equal here.

By means of this, an operation is conducted to determine to what extent the respective two data resemble one another, and it is possible to average the results of these operations, so that it is possible to rapidly and highly accurately compress data expressed in an analog format.

Here, the ROM type difference absolute value circuits described in embodiment 2 were employed in the combination of individual circuits; however, it is of course the case that no problems will be caused if the circuitry described in embodiment 4, embodiment 6, or embodiment 8 is employed, depending on the purpose.

(Embodiment 11)

Figure 12:
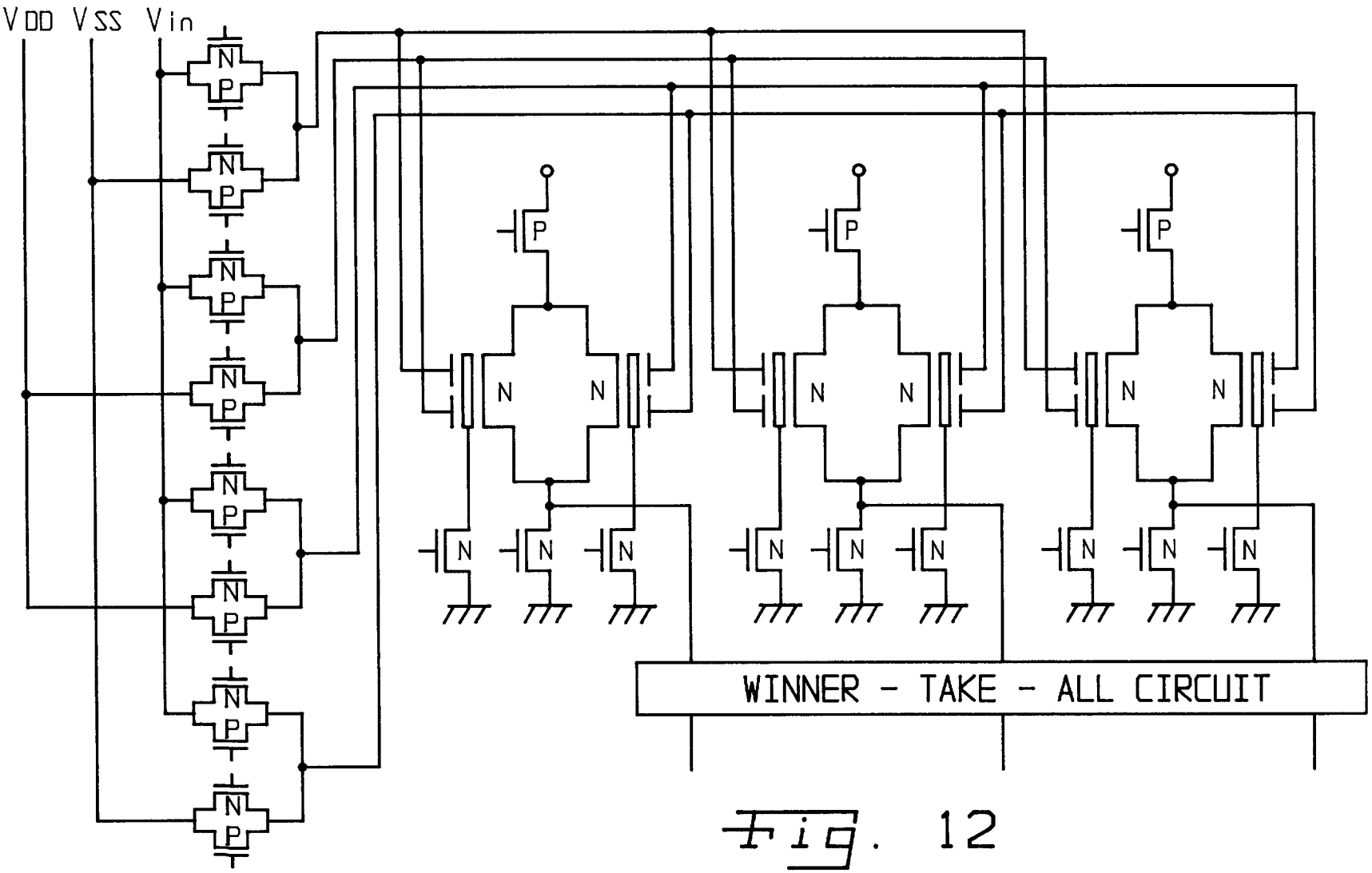
FIG. 12 is a circuit diagram relating to an eleventh embodiment.

FIG. 12 is a circuit diagram showing an eleventh embodiment. In this embodiment, a plurality of the ROM type difference absolute value circuits described in, for example, embodiment 1, are arranged, and the outputs thereof are inputted into the input terminals of a winner-take-all circuit and thereby, an operation is conducted which determines the smallest value among the operation results of the respective ROM type difference absolute value circuits.

By using this winner-take-all circuit in combination with ROM type difference absolute value circuits, it is possible to rapidly and highly accurately conduct operations to determine which datum, among a very large amount of data stored up to the present time, an inputted datum most nearly resembles.

Furthermore, here, the circuit structure involved a combination of 3 ROM type difference absolute value circuits and a three-input winner-take-all circuit; however, it is of course the case that any number of ROM type difference absolute value circuits may be employed, and these may be combined with a winner-take-all circuit having a the same number of inputs. Furthermore, the circuitry described in embodiment 1 was employed in this embodiment as the ROM type difference absolute value circuits; however, it is of course the case that no problems will caused if the circuits described in embodiment 3, embodiment 5, embodiment 7, or embodiment 9 are employed. Additionally, the winner-take-all circuit described hereinbelow as an example was employed as the winner-take-all circuit; however, it is of course the case that no problems will be caused if other circuits are employed in place of the winner-take-all circuit of the present embodiment, insofar as these circuits have the same function.

Figure 14:
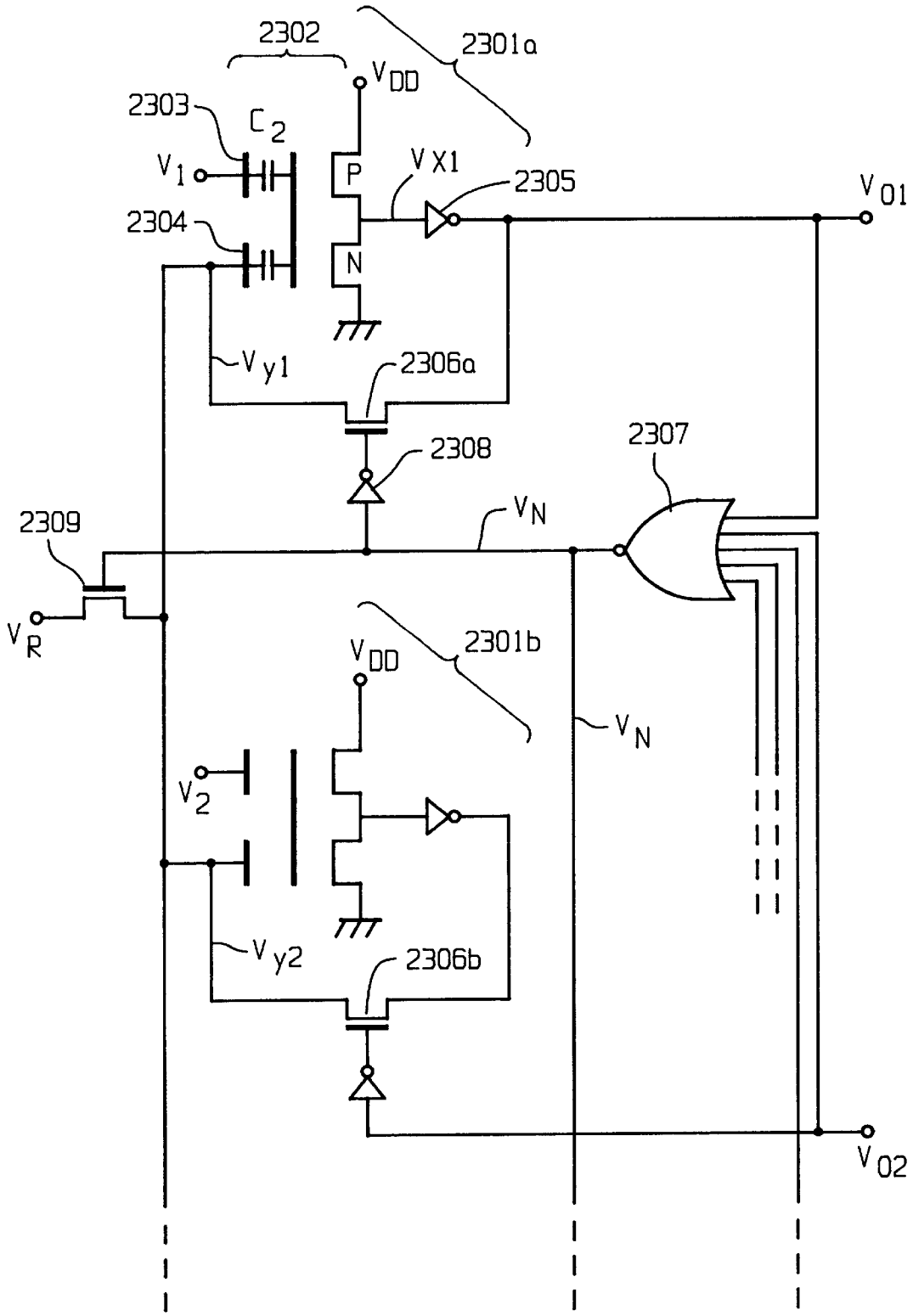
FIG. 14 is a schematic circuit diagram showing an example of a winner-take-all circuit which is optimally employed in the present invention.

With respect to the winner-take-all circuit which was employed as an example, a circuit having the structure shown in, for example, FIG. 14 may be employed. The circuit shown in FIG. 14 is disclosed in Japanese Patent Application, First Publication No. Hei 6-53431.

(Embodiment 12)

Figure 13:
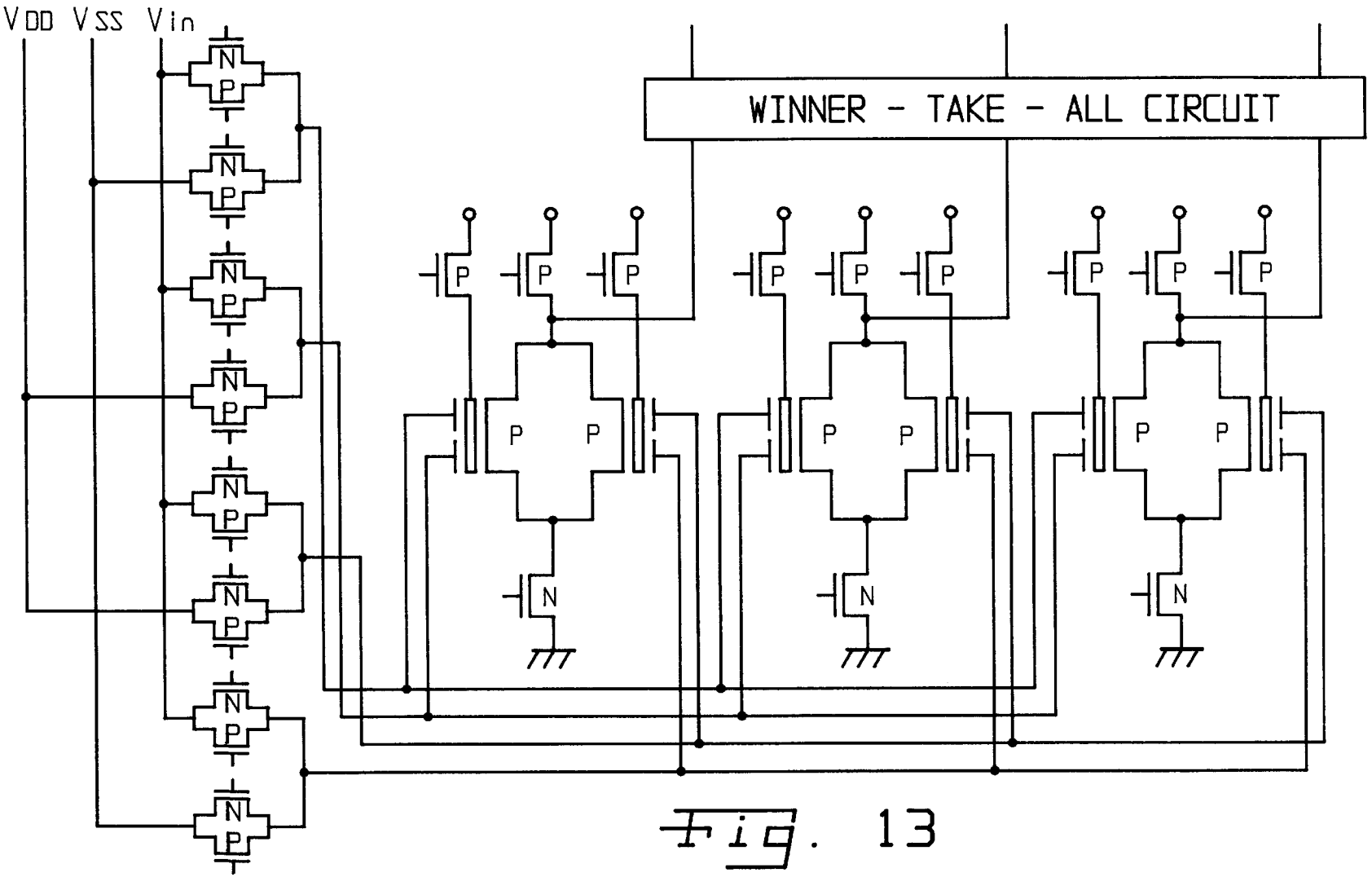
FIG. 13 is a circuit diagram relating to a twelfth embodiment.

FIG. 13 is a circuit diagram showing a twelfth embodiment. In this embodiment, a plurality of the ROM type difference absolute value circuits described in, for example, embodiment 2, are arranged, and the outputs thereof are inputted into the input terminals of a winner-take-all circuit and thereby, an operation is conducted which determines the smallest value among the operation results of the respective ROM type difference absolute value circuits.

By using this winner-take-all circuit in combination with ROM type difference absolute value circuits, it is possible to rapidly and highly accurately conduct operations to determine which datum, among a very large amount of data stored up to the present time, an inputted datum most nearly resembles.

Furthermore, here, the circuit structure involved a combination of 3 ROM type difference absolute value circuits and a three-input winner-take-all circuit; however, it is of course the case that any number of ROM type difference absolute value circuits may be employed, and these may be combined with a winner-take-all circuit having a the same number of inputs. Furthermore, the circuitry described in embodiment 2 was employed in this embodiment as the ROM type difference absolute value circuits; however, it is of course the case that no problems will caused if the circuits described in embodiment 4, embodiment 6, embodiment 8, or embodiment 10 are employed. Additionally, the winner-take-all circuit described hereinbelow as an example was employed as the winner-take-all circuit; however, it is of course the case that no problems will be caused if other circuits are employed in place of the winner-take-all circuit of the present embodiment, insofar as these circuits have the same function.

With respect to the winner-take-all circuit which was employed as an example, a circuit having the structure shown in, for example, FIG. 14 may be employed.

What is claimed is:

1. A semiconductor arithmetic circuit, comprising:

a signal line providing a predetermined potential;

a first MOS transistor and a second MOS transistor each having a gate electrode selectively switchable between a predetermined potential and an electrically floating state, a drain electrode connectable with said signal line, and a source electrode connectable with a ground potential and defining a circuit output;

a first electrode assembly having a plurality of input electrodes each capacitively coupled to the gate electrode of said first MOS transistor;

a second electrode assembly having a plurality of input electrodes each capacitively coupled to the gate electrode of said second MOS transistor;

an input circuit for operatively applying a respective selectable set of voltages to the input electrodes of each respective one of said first electrode assembly and said second electrode assembly to thereby define a respective voltage state thereof which produces an effective capacitively coupled transistor input voltage for the gate electrode of the respective MOS transistor associated therewith, each effective capacitively coupled transistor input voltage being defined at least in part as a function of the selected set of applied voltages associated therewith and the respective coupling capacitance values of the input electrodes associated therewith;

said arithmetic circuit having an operation comprising:

(i) operating said input circuit to place said first electrode assembly in a first voltage state producing a first effective capacitively coupled transistor input voltage and to place said second electrode assembly in a second voltage state producing a second effective capacitively coupled transistor input voltage, (ii) setting the respective gate electrode of each one of said first MOS transistor and said second MOS transistor to the predetermined potential associated therewith, (iii) placing the respective gate electrode of each one of said first MOS transistor and said second MOS transistor in the electrically floating state associated therewith, and (iv) operating said input circuit to place said first electrode assembly in said second voltage state and to place said second electrode assembly in said first voltage state, such that an output signal provided at said circuit output being representative of a difference between said first effective capacitively coupled transistor input voltage and said second effective capacitively coupled transistor input voltage.

2. A semiconductor arithmetic circuit in accordance with claim 1, wherein said MOS transistors comprise N channel MOS transistors.

3. A semiconductor arithmetic circuit in accordance with claim 2, wherein said source electrodes are connected to a capacity load, said source electrodes being respectively connectable with the ground potential via at least one respective switching element.

4. A semiconductor arithmetic circuit in accordance with claim 3, wherein said source electrodes are connected to a current source.

5. A semiconductor arithmetic circuit in accordance with claim 3, wherein each respective one of said first electrode assembly and said second electrode assembly includes a respective pair of input electrodes, in which the coupling capacities between said pair of input electrodes associated with said first MOS transistor and the gate electrode associated therewith are $C_1$ and $C_2$, and the coupling capacities between said pair of input electrodes associated with said second MOS transistor and the gate electrode associated therewith are $C_3$ and $C_4$, respectively, such that a ratio of the respective coupling capacities is $C_1/C_2=C_3/C_4$.

6. A semiconductor arithmetic circuit in accordance with claim 2, wherein said source electrodes are connected to a current source, said source electrodes being respectively connectable with the ground potential via at least one respective switching element.

7. A semiconductor arithmetic circuit in accordance with claim 2, wherein said source electrodes are connected to a current source.

8. A semiconductor arithmetic circuit in accordance with claim 2, wherein each respective one of said first electrode assembly and said second electrode assembly includes a respective pair of input electrodes, in which the coupling capacities between said pair of input electrodes associated with said first MOS transistor and the gate electrode associated therewith are $C_1$ and $C_2$, and the coupling capacities between said pair of input electrodes associated with said second MOS transistor and the gate electrode associated therewith are $C_3$ and $C_4$, respectively, such that a ratio of the respective coupling capacities is $C_1/C_2=C_3/C_4$.

9. A semiconductor arithmetic circuit in accordance with claim 1, wherein said MOS transistors comprise P channel MOS transistors.

10. A semiconductor arithmetic circuit in accordance with claim 9, wherein said source electrodes are connected to a capacity load, said source electrodes being respectively connectable with the ground potential via at least one respective switching element.

11. A semiconductor arithmetic circuit in accordance with claim 10, wherein said source electrodes are connected to a current source.

12. A semiconductor arithmetic circuit in accordance with claim 10, wherein each respective one of said first electrode assembly and said second electrode assembly includes a respective pair of input electrodes, in which the coupling capacities between said pair of input electrodes associated with said first MOS transistor and the gate electrode associated therewith are $C_1$ and $C_2$, and the coupling capacities between said pair of input electrodes associated with said second MOS transistor and the gate electrode associated therewith are $C_3$ and $C_4$, respectively, such that a ratio of the respective coupling capacities is $C_1/C_2=C_3/C_4$.

13. A semiconductor arithmetic circuit in accordance with claim 9, wherein said source electrodes are connected to a current source, said source electrodes being respectively connectable with the ground potential via at least one respective switching element.

14. A semiconductor arithmetic circuit in accordance with claim 9, wherein said source electrodes are connected to a current source.

15. A semiconductor arithmetic circuit in accordance with claim 9, wherein each respective one of said first electrode assembly and said second electrode assembly includes a respective pair of input electrodes, in which the coupling capacities between said pair of input electrodes associated with said first MOS transistor and the gate electrode associated therewith are $C_1$ and $C_2$, and the coupling capacities between said pair of input electrodes associated with said second MOS transistor and the gate electrode associated therewith are $C_3$ and $C_4$, respectively, such that a ratio of the respective coupling capacities is $C_1/C_2=C_3/C_4$.

16. A semiconductor arithmetic circuit in accordance with claim 1, wherein said source electrodes are connected to a current source.

17. A semiconductor arithmetic circuit in accordance with claim 16, wherein each respective one of said first electrode assembly and said second electrode assembly includes a respective pair of input electrodes, in which the coupling capacities between said pair of input electrodes associated with said first MOS transistor and the gate electrode associated therewith are $C_1$ and $C_2$, and the coupling capacities between said pair of input electrodes associated with said second MOS transistor and the gate electrode associated therewith are $C_3$ and $C_4$, respectively, such that a ratio of the respective coupling capacities is $C_1/C_2=C_3/C_4$.

18. A semiconductor arithmetic circuit in accordance with claim 1, wherein each respective one of said first electrode assembly and said second electrode assembly includes a respective pair of input electrodes, in which the coupling capacities between said pair of input electrodes associated with said first MOS transistor and the gate electrode associated therewith are $C_1$ and $C_2$, and the coupling capacities between said pair of input electrodes associated with said second MOS transistor and the gate electrode associated therewith are $C_3$ and $C_4$, respectively, such that a ratio of the respective coupling capacities is $C_1/C_2=C_3/C_4$.

19. The semiconductor arithmetic circuit as recited in claim 1, wherein each respective one of said first electrode assembly and said second electrode assembly includes a respective pair of input electrodes.

20. The semiconductor arithmetic circuit as recited in claim 19, wherein said first voltage state of an electrode assembly being characterized by the application thereto of a pair of different voltage potentials by said input circuit, and said second voltage state of an electrode assembly being characterized by the application thereto of a common voltage potential by said input circuit.

21. The semiconductor arithmetic circuit as recited in claim 20, wherein said pair of different voltage potentials associated with said first voltage state comprising a ground potential and a power source potential, and said common voltage potential associated with said second voltage state comprising a circuit input signal voltage.

* * * * *